US007616168B2

(12) United States Patent
Tillery

(10) Patent No.: US 7,616,168 B2
(45) Date of Patent: Nov. 10, 2009

(54) METHOD AND SYSTEM FOR INCREASING THE ISOLATION CHARACTERISTIC OF A CROSSED DIPOLE PAIR DUAL POLARIZED ANTENNA

(75) Inventor: James K. Tillery, Woodstock, GA (US)

(73) Assignee: Andrew LLC, Hickory, NC (US)

( * ) Notice: Subject to any disclaimer, the term of this patent is extended or adjusted under 35 U.S.C. 154(b) by 296 days.

(21) Appl. No.: 11/467,603

(22) Filed: Aug. 28, 2006

(65) Prior Publication Data

US 2007/0046558 A1 Mar. 1, 2007

Related U.S. Application Data

(60) Provisional application No. 60/711,959, filed on Aug. 26, 2005.

(51) Int. Cl.
*H01Q 21/26* (2006.01)

(52) U.S. Cl. ..... 343/797; 343/798

(58) Field of Classification Search ..... 343/797, 343/798

See application file for complete search history.

(56) References Cited

U.S. PATENT DOCUMENTS

| | | | | |
|---|---|---|---|---|
| 3,710,333 | A | 1/1973 | Crom | 343/114 |
| 3,827,054 | A | 7/1974 | Herskind | 343/708 |
| 5,047,787 | A | 9/1991 | Hogberg | 343/841 |
| 5,298,906 | A | 3/1994 | Lantagne et al. | 342/175 |
| 5,373,297 | A | 12/1994 | Briguglio | |
| 5,481,272 | A | 1/1996 | Yarsunas | 343/797 |
| 5,574,994 | A | 11/1996 | Huang et al. | 455/126 |
| 5,771,024 | A | 6/1998 | Reece et al. | 343/725 |
| 5,818,397 | A | 10/1998 | Yarsunas et al. | 343/797 |
| 5,841,401 | A | 11/1998 | Bodley et al. | 343/700 MS |
| 5,945,951 | A | 8/1999 | Monte et al. | 343/700 MS |
| 5,952,983 | A | 9/1999 | Dearnley et al. | 343/817 |

(Continued)

FOREIGN PATENT DOCUMENTS

| | | |
|---|---|---|
| EP | 001883 | 5/1979 |

(Continued)

OTHER PUBLICATIONS

Teichman, M.A., "Designing Wire Grids for Impedance Matching of Dielectric Sheets", *The Microwave Journal*, Apr. 1968, pp. 73-78.

*Primary Examiner*—Trinh V Dinh
*Assistant Examiner*—Dieu Hien T Duong
(74) *Attorney, Agent, or Firm*—Husch Blackwell Sanders LLP Welsh & Katz

(57) ABSTRACT

A method and system for increasing an isolation characteristic of a crossed dipole pair, dual polarized antenna can include a feedback system comprising a feedback element for generating a feedback signal in response to a transmitted RF signal produced by each radiating elements of a crossed dipole pair, dual polarized antenna. The feedback element may improve the isolation characteristic of RF signals between two different polarizations. The dimensions and spacing of the feedback element relative to an antenna may provide for optimal feedback signals. The feedback element can have a length, width, and thickness wherein the length and width are usually larger than the thickness dimension. A fastening mechanism of the inventive feedback system for coupling the feedback element to the antenna can include materials that allow for high speed production of antenna arrays using with the feedback system.

20 Claims, 14 Drawing Sheets

U.S. PATENT DOCUMENTS

| | | | | |
|---|---|---|---|---|
| 6,025,812 | A | 2/2000 | Gabriel et al. | |
| 6,034,649 | A | 3/2000 | Wilson et al. | |
| 6,067,053 | A | 5/2000 | Runyon et al. | |
| 6,069,586 | A | 5/2000 | Karlsson et al. | |
| 6,069,590 | A * | 5/2000 | Thompson et al. | 343/795 |
| 6,104,348 | A | 8/2000 | Karlsson et al. | |
| 6,137,444 | A | 10/2000 | Pettersson et al. | |
| 6,329,954 | B1 * | 12/2001 | Fuchs et al. | 343/725 |
| 6,515,633 | B2 | 2/2003 | Ippolito | |
| 6,529,172 | B2 | 3/2003 | Zimmerman | |
| 6,597,324 | B2 | 7/2003 | Eriksson | |
| 6,608,600 | B2 | 8/2003 | Eriksson | |
| 6,734,829 | B1 | 5/2004 | Göttl | |
| 6,847,328 | B1 * | 1/2005 | Libonati et al. | 343/700 MS |
| 6,933,905 | B2 | 8/2005 | Ippolito | |

FOREIGN PATENT DOCUMENTS

| | | |
|---|---|---|
| JP | 56013812 | 2/1981 |
| JP | 59194517 | 11/1984 |
| WO | WO 97/22159 | 6/1997 |
| WO | WO 02/41451 | 5/2002 |

* cited by examiner

METHOD AND SYSTEM FOR INCREASING THE ISOLATION CHARACTERISTIC OF A CROSSED DIPOLE PAIR DUAL POLARIZED ANTENNA

STATEMENT REGARDING RELATED APPLICATIONS

The present application claims priority to provisional application entitled, "Isolation Card for Antennas," filed on Aug. 26, 2005 and assigned U.S. Application Ser. No. 60/711,959. The entire contents of the provisional patent application are hereby incorporated by reference.

FIELD OF INVENTION

This invention relates to antennas for communicating electromagnetic signals and, more particularly, to improving sensitivity of a crossed dipole pair dual polarized antenna by increasing the isolation characteristic of the antenna.

BACKGROUND OF THE INVENTION

Many types of antennas are in wide use today throughout the communications industry. The antenna has become an especially critical component for an effective wireless communication system due to recent technology advancements in areas such as Personal Communications Services (PCS), cellular mobile radiotelephone (CMR) service, and Advanced Mobile Phone System (AMPS) service.

Some conventional PCS, CMR, and AMPS systems can use vertically or horizontally, singularly polarized antennas to transmit and receive RF communications. An example of such a conventional system is illustrated in FIG. 1A. In this Figure, spatial separation is used between the three antenna arrays 100A, 100B, and 100C in order to avoid electrical interference and thus increase electrical isolation between each antenna array 100.

In the exemplary conventional system illustrated in FIG. 1A, single polarization transmitting or receiving antenna arrays 100 can be separated by distances 105 having a magnitude such as on the order of approximately ten wavelengths. This means that individual receiving or transmitting antenna elements 102 of one antenna array 100 would be separated from another like antenna array 100 by a distance of approximately ten wavelengths.

While this physical separation between like antenna arrays 100 can reduce electrical interference and increase electrical isolation, this arrangement is often not practical given the tight spacing and electronic packaging requirements imposed on most antennas. That is, physical separation between antenna arrays and/or antenna elements is often not possible when antennas are required to occupy a space or volume that may be smaller than the optimal antenna wavelength separation.

To address small space or volume requirements, dual polarized antennas can be used. Specifically, a crossed dipole pair radiator having two radiating sub-elements that are polarity specific to transmit and receive RF signals at two different polarizations can be employed. In a conventional crossed dipole pair antenna, such as illustrated in FIG. 1B, the dipoles for each polarization of a respective crossed dipole pair dual polarized antenna array 115 are usually collocated or very close to each other so that there is essentially no physical separation at all between transmitting and receiving antenna elements. In the antenna system illustrated in FIG. 1B, a duplexer 120 can be used to switch between transmitted and received RF signals.

The dual polarization antenna illustrated in FIG. 1B is prevalent in the wireless communications industry due to the polarization diversity properties that are inherent in this type of antenna. This type of crossed dipole pair dual polarized antenna can increase the antenna's signal handling capacity and can mitigate the deleterious effects of fading and cancellation that often result from today's complex propagation environments.

Dual polarized antennas in general are usually designed in the form of an array antenna and have a feed network associated with each of the two dipoles of the crossed dipole pair. A dual polarized antenna is usually characterized by having two antenna connection terminals or ports for communicating signals to the antenna that are to be transmitted, and for outputting signals from the antenna that have been received. Thus the connection ports serve as both input ports and as output ports at any time, or concurrently, depending on the antenna's transmit or receive mode of operation.

An undesirable leakage signal can appear at one of these ports as a result of a signal present at the opposite port and part of that signal being electrically coupled, undesirably so, to the opposing port. This coupling can occur when stray radiation from one antenna element is detected by the opposing antenna element. A leakage signal can also be produced by self-induced coupling when a signal propagates through a feed network.

The measuring of leakage signals in a dual polarized crossed dipole antenna is illustrated in the conventional art of FIG. 1C. A main transmission signal al can be supplied at port 35. This transmission signal al is propagated by the antenna elements 11 coupled to port 35 when these antenna elements 11 are operating in a transmit mode. An undesirable leakage signal b1 can be measured at port 35 as a result of the transmission signal a1 exciting portions of the feed network such as distribution network 15.

In another example, the undesirable leakage signal b1 can be measured at port 35 when a transmission signal a2 is supplied at port 40. The transmission signal a2 can excite portions of the feed network such as distribution network 17 which in turn, can excite antenna elements 11, 12 or distribution network 15 or both. It is noted that other leakage signals (not shown) may be measured at port 40 which are caused by transmission signal a2 itself or RF signals supplied at port 35.

A dual polarized antenna's performance in terms of it transmitting an RF signal with low antenna loss of the signal, or of it receiving an RF signal and having low antenna loss at the antenna's output received signal, can be measured in large part by the signals' electrical isolation between the antenna's two connection ports, i.e., the port-to-port isolation at the connectors or the minimizing of the leakage signal b1. Dual polarized antennas can also have radiation isolations defined in the far-field of the antenna which differ from port-to-port isolations defined at the antenna connectors. The focus of the invention described in detail later in this document is not on far-field isolation, but rather with port-to-port isolations at connector terminals of a dual polarized antenna.

While a dual polarized antenna can be formed using a single radiating element, the more common structure is an antenna having an array of dual polarized radiating elements 10. In practice, both the transmit and receive functions often occur simultaneously and the transmit and received signals may also be at the same frequency. So there can be a significant amount of electrical wave activity taking place at the antenna connectors, or ports, sometimes also referred to as signal summing points.

The effect of the significant amount of electrical wave activity during simultaneous transmission and reception of RF signals can be explained as follows. Poor receive sensitivity, and poor radiated output, often results due to internal antenna loss when part of one of the signals at one input port (port one) leaks or is otherwise coupled as a leakage signal to the other port (port two). Such leakage or undesired coupling of a signal from one port to the other may adversely combine with the signal at the other port to diminish the strength of both signals and hence reduce the effectiveness of the antenna.

When port-to-port isolation is minimal, i.e., leakage is maximum, the antenna system will perform poorly in the receive mode in that the reception of incoming signals will be limited only to the strongest incoming signals and lack the sensitivity to pick up faint signals due to the presence of leakage signals interfering with the weaker desired signals. In the transmit mode, the antenna performs poorly due to leakage signals detracting from the strength of the radiated signals.

Adding to the complexity of electrical wave activity during simultaneous transmission and reception of RF signals with dual polarized antennas is the positioning of dual polarized antennas operating in different frequency bands. Currently, there is a trend in the conventional art towards using dual band antennas in close proximity with one another which cover two frequency bands (a high frequency band and a low frequency band) within one mechanical package.

For example, as illustrated in FIG. 1D, an antenna array 117 can comprise high frequency band antenna elements 115B and low frequency band antenna elements 115A. As understood by one of ordinary skill in the art, the high frequency band antenna elements 115B have resonant dimensions that are smaller when compared to the low frequency band antenna elements 115A. A dual band, crossed dipole dual polarized antenna array 117 can further complicate the isolation problem because there can be interference between the two orthogonal radiated fields in a single frequency band, as well as interference between the high frequency and low frequency band antenna elements 115A, 115B.

Conventional Isolation Techniques

One known technique for minimizing this leakage signal problem is by incorporating proper impedance matching within the distribution networks that generate the two sets of RF signals. Impedance mismatching can cause leakage signals to occur and degrade the port-to-port isolation if (1) a cross-coupling mechanism is present within the distribution network or in the radiating elements, or if (2) reflecting features are present beyond the radiating elements. Proper impedance matching can minimize the amount of impedance mismatch that a signal experiences when passing through a distribution network, thereby increasing the port-to-port isolation.

In general, when impedance mismatches are present, part of a signal is reflected back and not passed through the area of impedance mismatch. In a dual polarized antenna system, the reflected signal can result in a leakage signal at the opposite port or the same port and it can cause a significant degradation in the overall isolation characteristic and performance of the antenna system. While impedance matching helps to increase port-to-port isolation, it falls short of achieving the high degree of isolation that is now required in the wireless communications industry.

Another technique for increasing the isolation characteristic is the physical separation of transmitting and receiving antenna elements as noted above and as illustrated in FIG. 1A. Individual radiating elements of an antenna array can be positioned sufficiently apart on the order of wavelengths in order to increase antenna isolation. However, as noted above, the physical area and dimensional constraints placed on the antenna designs of today for use in cellular base station towers generally render the physical separation technique impractical in all but a few instances.

Another technique for improving an antenna's isolation characteristic is to place a physical wall between each of the radiating elements. Still another is to modify the ground plane of the antenna system so that the ground plane associated with each port is separated by either a physical space or a non-conductive obstruction that serves to alleviate possible leakage between the two signals otherwise caused by coupling due to the two ports sharing a common ground plane. These techniques can help in increments, but usually do not solve the magnitude of the signal leakage problem.

Still another conventional technique for improving the isolation characteristic of an antenna is to use a feedback element to provide a feedback signal to pairs of radiators in the antenna array. The feedback element can be in the form of a conductive strip placed on top of a foam bar that can be positioned between crossed dipole radiators.

While the conductors, according to this technique, can increase the isolation characteristic, the foam bars that support the conductive strips positioned between crossed dipole pair antennas can have mechanical properties that are not conducive to the operating environment of the antenna. For example, the foam bars are typically made of non-conducting, polyethylene foam or plastic. Such materials are usually bulky and are difficult to accurately and precisely position between antenna elements.

Additionally, these support blocks have coefficients of thermal expansion that are typically not conducive to extreme temperature fluctuations in the outside environment in which the antenna functions, and they readily expand and contract depending on temperature and humidity. In addition to the problems with thermal expansion, the support blocks are also not conducive for rapid and precise manufacturing. Furthermore, these types of support blocks do not provide for accurate placement of the conductive strips or feedback elements on the distribution network board.

Consequently, there is a need in the art for a method and system that facilitates the design of a dual polarized antenna system, and specifically, a crossed dipole antenna pair, with a high degree of isolation between two respective antenna connection ports that more thoroughly cancels out any port-to-port leakage signals and at the same time, is conducive to high speed manufacturing and a high degree of accurate repeatability. There is also a need in the art for an antenna isolation method and system that can withstand extreme operating environments in which a cellular base station antenna is exposed.

SUMMARY OF THE PRESENT INVENTION

A method and system for increasing an isolation characteristic of a crossed dipole pair, dual polarized antenna can include a feedback system comprising a feedback element for generating a feedback signal in response to a transmitted RF signal produced by each radiating elements of a crossed dipole pair, dual polarized antenna. In such an exemplary embodiment, the feedback element may improve the isolation characteristic of RF signals between two different polarizations.

One inventive aspect of the technology can include positioning of the feedback element relative to the radiators of the crossed dipole pair antenna. According to one exemplary aspect, the feedback element can be precisely positioned along a first imaginary geometrical line that intersects a geometric center of the crossed dipole pair antenna. The first imaginary geometrical line can be defined by a length dimension of a feedback element.

The geometric center of the crossed dipole pair antenna can be defined by each of the two dipoles of the crossed dipole antenna. Second and third imaginary geometrical lines may be defined by each length dimension of each dipole of the crossed dipole pair. The intersection of the second and third geometrical lines defined by length dimensions of the two dipoles at a ninety degree angle can define the geometric center of the crossed dipole pair.

The first geometrical line defined by the length dimension of the feedback element can be positioned at an angle relative to each second and third geometrical lines defined by the length dimensions of the crossed dipole pair. Specifically, the first geometrical line can be positioned at an angle of approximately forty-five degrees relative to the second and third geometrical lines while the first geometrical line crosses the center of the crossed dipole pair antenna.

In addition to the positioning of the feedback element within a geometric plane defined by the three geometrical lines noted above, the positioning of the feedback element as defined by a physical separation between the first geometrical line and a geometric plane formed by only the second and third geometrical lines noted above may also be unique. The spacing between the first geometrical line defined by a substantially linear portion of the feedback element and the geometric plane defined by only the second and third geometrical lines can be approximately seven-thousandths (0.007) of a wavelength at an operating frequency of the antenna. In other words, the feedback element can "float" above the crossed dipole pair radiator at a distance of approximately seven-thousandths of a wavelength at an operating frequency of the crossed dipole pair, dual polarized antenna.

Another inventive aspect of the feedback element can include its length. The length of the feedback element can be between approximatety one-eighth and one-half of a wavelength of the operating frequency of the crossed dipole pair antenna. Further inventive aspects of the feedback element can include its width dimension and thickness dimension. According to one exemplary aspect, the feedback element can have a thickness dimension of approximately two-thousandths (0.002) of a wavelength at an operating frequency of the antenna. According to another exemplary aspect, the feedback element can have a width dimension of approximately fourteen-thousandths (0.014) of a wavelength at an operating frequency of the antenna. According to one exemplary aspect, the feedback element can have a length, width, and thickness wherein the length and width are larger than the thickness.

In addition to the dimensions of the feedback element and the positioning of the feedback element that includes its orientation relative to the geometrical center of the crossed dipole pair and its spacing from the geometrical center, another unique aspect can include the fastening mechanism that the physically connects the feedback element to the crossed dipole pair antenna. The fastening mechanism of the inventive feedback element can include materials that permit a high degree of control over the material properties of the fastening mechanism. Each fastening mechanism can include an insulative material that has electrical and mechanical properties that are conducive to extreme operating environments of antenna arrays. For example, such fastening mechanisms can be selected to provide appropriate dielectric constants (relative permeability), loss tangent (conductivity), and coefficient of thermal expansion in order to optimize the isolation between respective antenna elements in an antenna array.

According to one exemplary aspect, the fastening mechanism can comprise a pair of tabs extending from the feedback element to define a groove that can be combined with an adhesive, such as an epoxy. The pair of tabs can extend from a length dimension of the feedback element at a ninety degree angle to form the groove therebetween. The groove can be used to position the feedback element across the geometric center crossed dipole pair, dual polarized antenna. The adhesive can be used to fasten the tabs to the center portion of the crossed dipole pair, dual polarized antenna.

According to another exemplary aspect, the fastening mechanism can include only an adhesive without any tabs extending from the feedback element. According to this exemplary aspect, a sufficient amount of adhesive can be supplied to support and fasten the feedback element to the crossed dipole pair, dual polarized antenna alone without any additional mechanical elements.

According to another further exemplary aspect, the fastening mechanism can include spring feet that are milled out of the feedback element itself. These spring feet can then snap the feedback element into place on the center of the crossed dipole pair, dual polarized antenna. The spring feet can contact the center portion of the crossed dipole pair, dual polarized antenna. The use of adhesive may be eliminated in this exemplary embodiment.

According to another exemplary aspect, the fastening mechanism can include an extension of one or more portions of a dielectric material that is used to support the metallic elements of the crossed dipole pairs, of the dual polarized antenna. The fastening mechanism can further include a groove that is present in the feedback element to receive the extension of the dielectric material. The fastening mechanism can also include an adhesive to hold the groove of the feedback element in place over the extension of the dielectric material.

Each feedback element can be made of a metal, such as stainless steel or aluminum. The metal of the feedback element can be readily combined with one of the fastening mechanisms described above. Such feedback elements are conducive for high volume production environments while maintaining high quality standards. The manufacturing processes for such feedback elements can provide the advantage of small tolerances.

According to another exemplary aspect, the feedback element can have an extended "C" shape in which a middle portion of the "C" shape can be substantially linear. The "C" shaped feedback element can be a concaved geometry in which the opening of the "C" shape opens or faces towards the crossed dipole pair, dual polarized antenna. Each end of the linear middle portion of the "C" shape feedback element may include an element that extends at an angle, such as a forty-five degree angle, relative to the substantially linear middle portion of the "C" shape.

The feedback signal that can be produced by each feedback element can be received by each radiator or dipole of the crossed dipole pair dual polarized antenna. Each radiator or dipole can also be described as a radiating element, and may radiate any leakage signal present at the output port of the antenna. Because the feedback signal and the leakage signal are set to the same frequency and are usually approximately 180 degrees out of phase, this signal summing operation serves to cancel both signals at the output port, thereby improving the port-to-port isolation characteristic of the antenna.

The characteristics of the feedback signal, including amplitude and phase, can be adjusted by varying the position of the feedback element relative to the radiating element thereby affecting the amount of coupling therebetween and, hence, the amount of port-to-port isolation. The feedback signal can be further adjusted by placing additional feedback elements into the dual polarized antenna system until a specific amount of feedback coupling is produced so to enable the cancellation of any leakage signals passing a first port to a second port.

In an alternate exemplary embodiment, the feedback elements can be combined with multiple frequency band radiating crossed dipole pair dual polarized antenna elements. In this way, signals between different operating frequencies can be isolated from one another.

According to other exemplary aspects, the feedback element may be positioned in other orientations in which the first geometrical line defined by the length of the feedback element does not intersect the geometrical center of the crossed dipole pair antenna. Further, according to other exemplary aspects, the feedback element can be positioned between a geometric plane defined by the crossed dipole pairs and a ground plane.

It is further noted that the conductive feedback element may have various shapes or geometries. For example, the feedback elements may be in the form of strips, or according to additional exemplary aspects, the feedback element can include different geometries such as straight, curved, sinusoidal, H-shaped, wedged-shape, circular, rectangular, and triangular shapes.

It is further noted that multiple feedback elements may be positioned in an antenna array and in a variety of configurations with equal success, such as non-uniform feedback element spacing (non-symmetrical patterns), and tilted feedback elements (introducing a rotational angle) relative to each respective neighboring feedback elements.

In view of the foregoing, it will be readily appreciated that the present invention provides for the design and tuning method of a crossed dipole pair dual polarized antenna system or a multiple frequency band, crossed dipole pair dual polarized antenna system having a high port-to-port isolation characteristic thereby overcoming the sensitivity problems associated with prior antenna designs. Other features and advantages of the present invention will become apparent upon reading the following specification, when taken in conjunction with the drawings and the appended claims.

DETAILED DESCRIPTION OF EXEMPLARY EMBODIMENTS

Figure 1A:
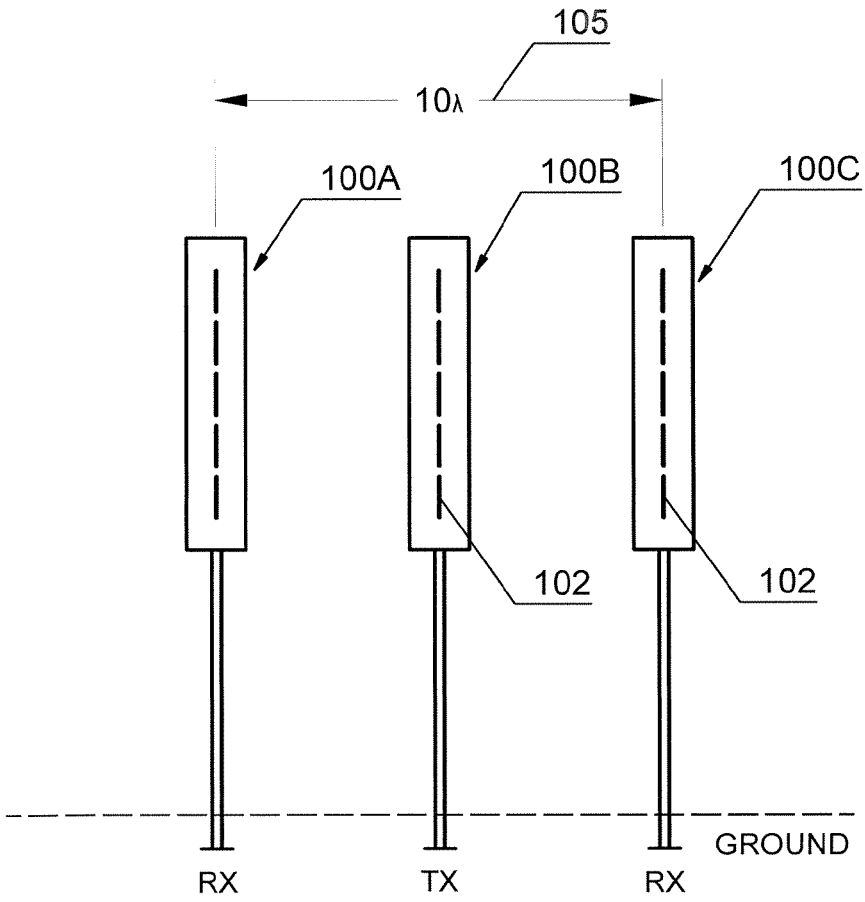
FIG. 1A CONVENTIONAL ART
FIG. 1A is a functional block diagram illustrating components of conventional single polarized array antennas that are spaced apart at predetermined distances in order to increase isolation between respective arrays and antenna elements within the arrays.
Figure 1B:
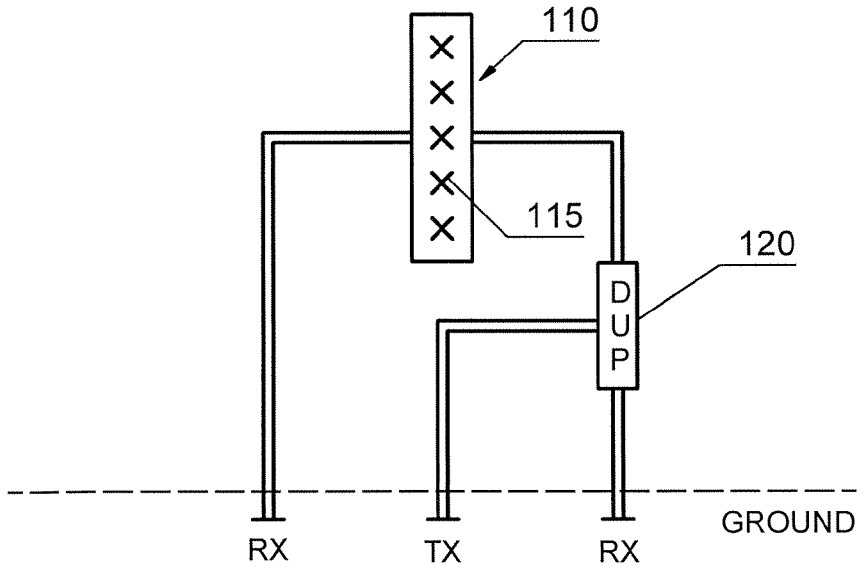
FIG. 1B CONVENTIONAL ART
FIG. 1B is a functional block diagram illustrating components of a conventional dual polarized antenna array made of crossed dipole pair antenna elements.
Figure 1C:
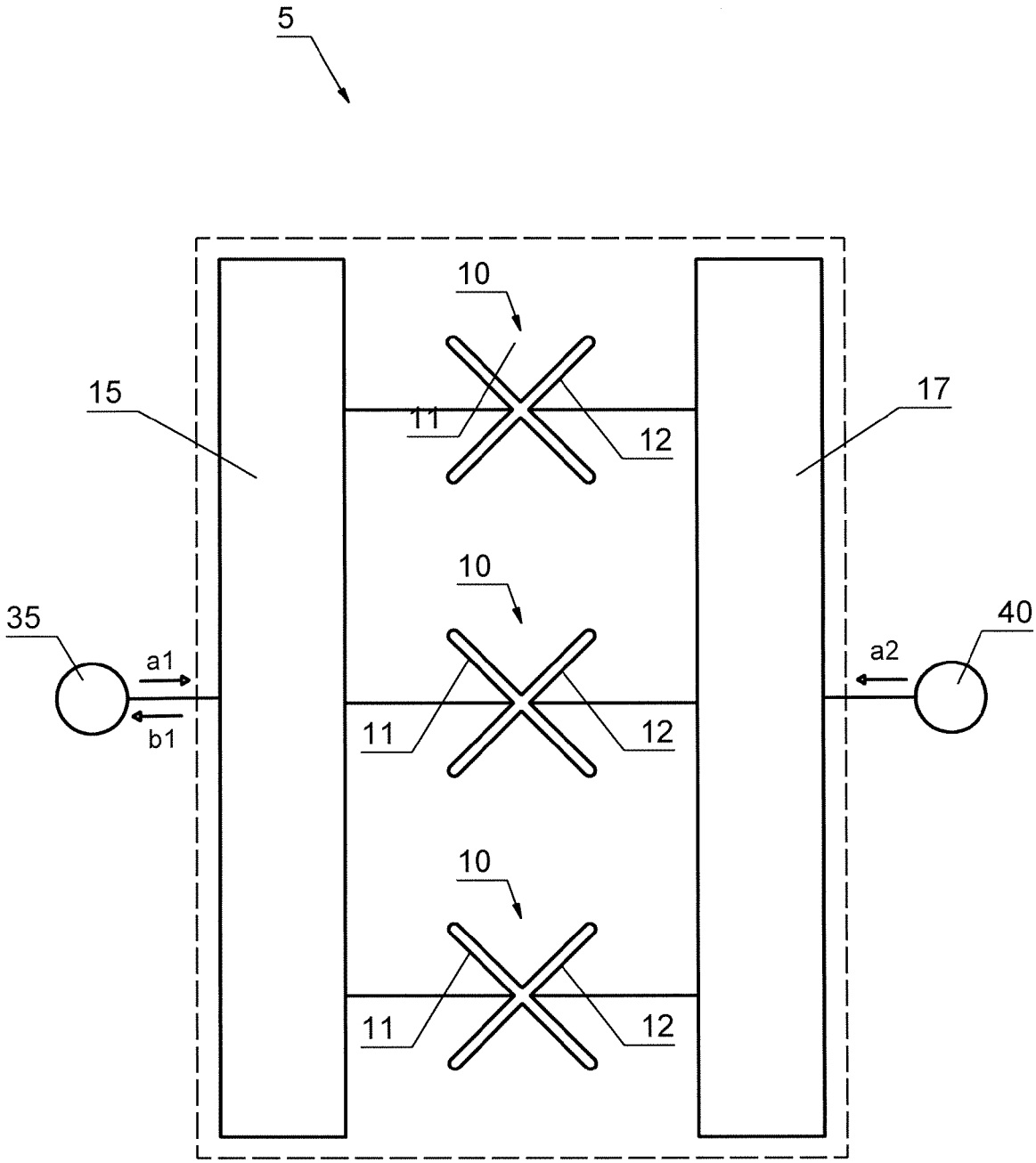
CONVENTIONAL ART FIG. 1C
FIG. 1C is a functional block diagram illustrating components of a conventional dual polarized antenna array made of crossed dipole pair antenna elements in addition to feed networks and ports that supply RF signals to the antenna array.
Figure 1D:
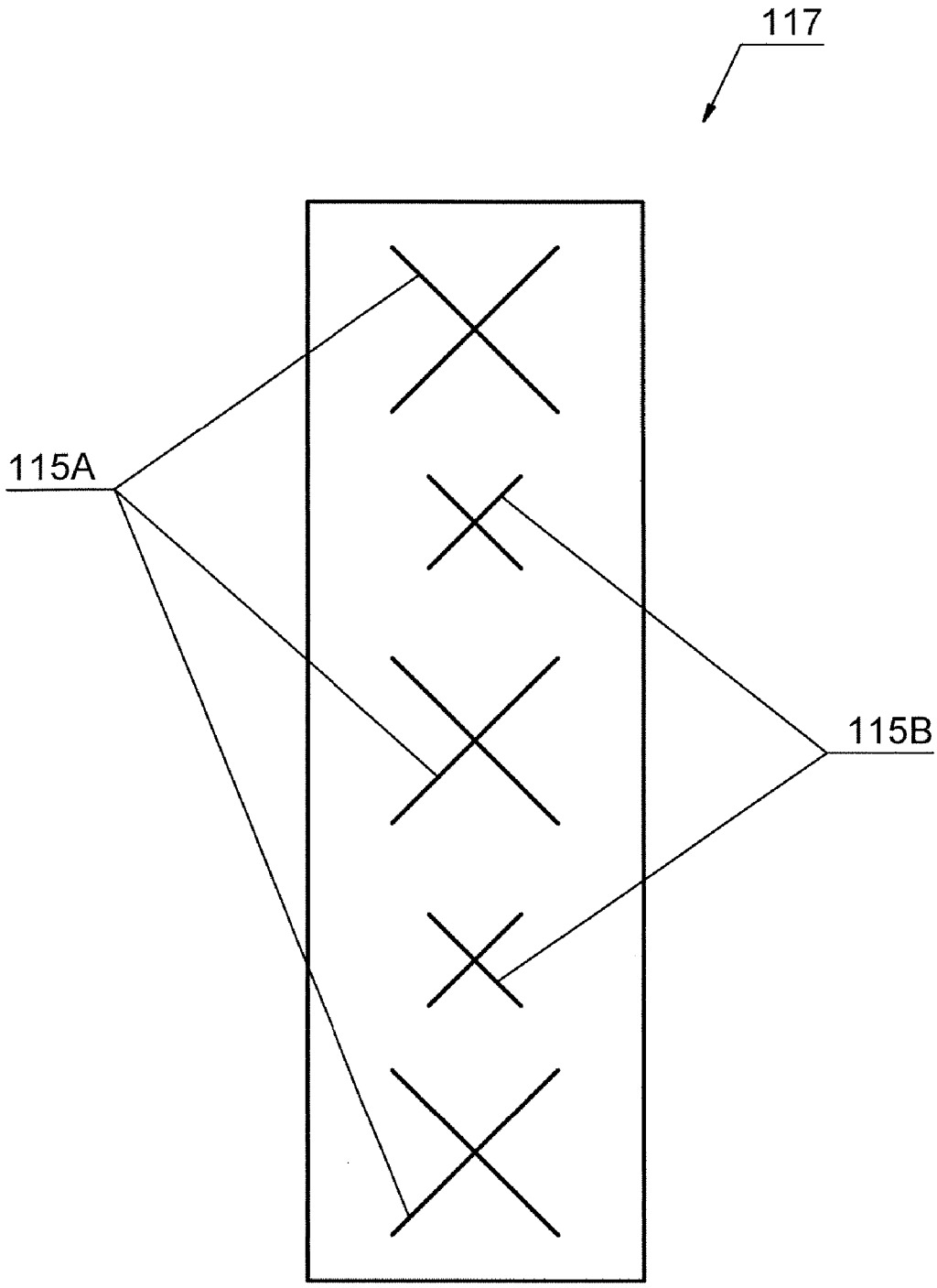
FIG. 1D is a functional block diagram illustrating components of a conventional dual polarized, dual frequency band antenna array made of crossed dipole pair antenna elements with different resonant dimensions.

A method and system for increasing an isolation characteristic of a crossed dipole pair, dual polarized antenna can include a feedback system comprising a feedback element for generating a feedback signal in response to a transmitted RF signal produced by each radiating elements of a crossed dipole pair, dual polarized antenna. In such an exemplary embodiment, the feedback element may improve the isolation characteristic of RF signals between two different polarizations.

One inventive aspect of the technology can include positioning of the feedback element relative to the radiators of the crossed dipole pair antenna. The feedback element can "float" above the crossed dipole pair radiator at a distance of approximately 0.007 of a wavelength at an operating frequency of the crossed dipole pair, dual polarized antenna. The length of the feedback element can be between approximately one-eighth and one-half of a wavelength of the operating frequency of the crossed dipole pair antenna. The feedback element can have thickness dimension of approximately two thousandths (0.002) of a wavelength at an operating frequency of the antenna.

The feedback element can also have a width dimension of approximately fourteen-thousandths (0.014) of a wavelength at an operating frequency of the antenna. According to one exemplary aspect, the feedback element can have a length, width, and thickness wherein the length and width are larger than the thickness dimension. A fastening mechanism of the inventive feedback system can include materials that permit a high degree of control over the material properties of the fastening mechanism. Each fastening mechanism can include an insulative material that has electrical and mechanical properties that are conducive to extreme operating environments of antenna arrays.

The feedback system of the present invention can solve the aforementioned problems of leakage signals in, especially, a crossed dipole pair dual polarized antenna and is useful for enhancing antenna performance for wireless communication applications, such as base station cellular telephone service that can include Personal Communications Service (PCS), cellular mobile radiotelephone (CMR) service, and Advanced Mobile Phone System (AMPS) service.

Basic to antenna operation is the principal of reciprocity. An antenna operates with reciprocity in that the antenna can be used to either transmit or receive signals, to transmit and receive signals at the same time, and to even transmit and receive signals concurrently at the same frequency. It is understood, therefore, that the invention described is applicable to an antenna operating in either a transmit or receive mode or, as is more normally the case at a cellular antenna base station, operating in both modes simultaneously. The invention operates basically the same way regardless of whether the antenna is transmitting or receiving dual polarized signals at its radiating dipole pairs.

For simplicity in the description that follows, the antenna system is described generally as operating in a transmit mode. The feedback system of the invention, like the dual polarized antenna of one exemplary embodiment, operates basically the same way regardless of whether the antenna is transmitting or receiving dual polarized signals at its dipole pair.

Also for the purpose of illustrating the present invention, the preferred embodiment is described in terms of its application to a crossed dipole pair dual polarized antenna, with it understood that use of the invention is not limited to this type of antenna.

Referring now to the drawings, in which like numerals represent like elements throughout the several Figures, aspects of the invention and the illustrative operating environment will be described.

Figure 2:
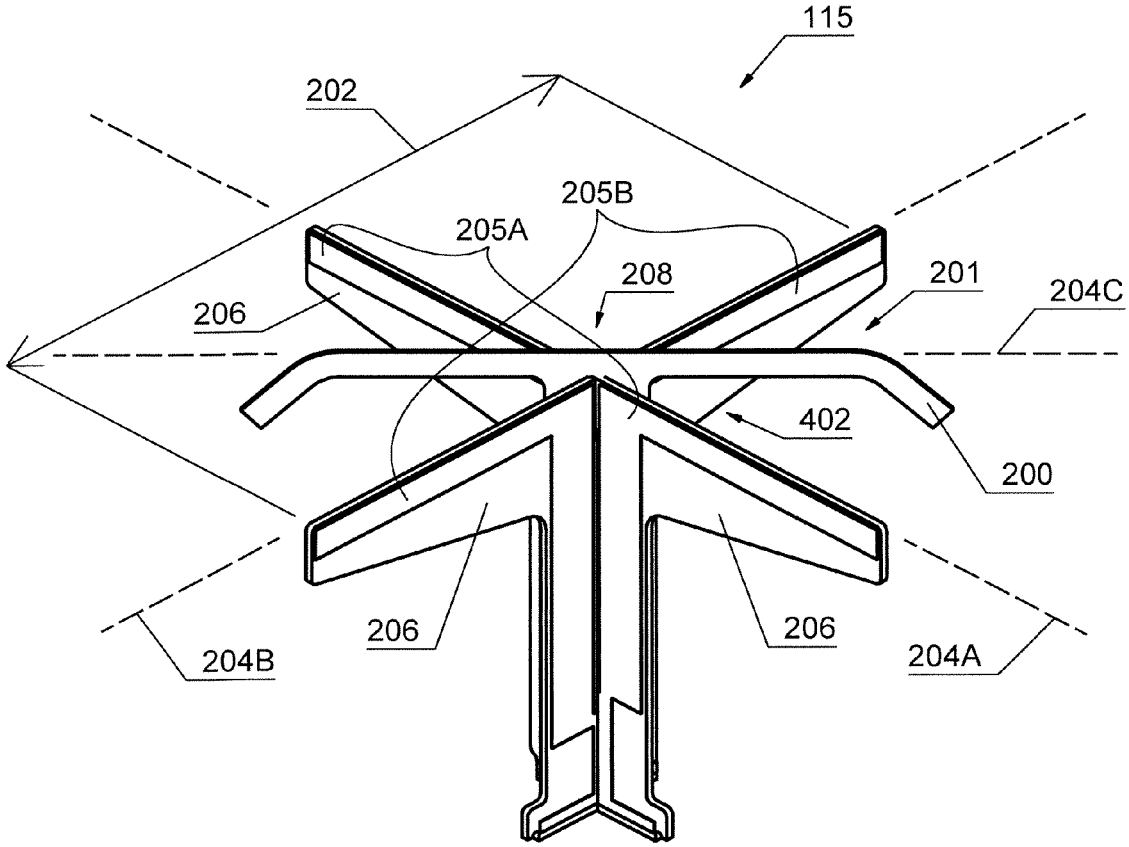
FIG. 2 is an illustration showing an isometric view of an exemplary feedback system coupled to a single crossed dipole pair dual polarized antenna according to one exemplary embodiment of the invention.

Referring to FIG. 2, this figure is an illustration showing an isometric view of an exemplary feedback system 201 coupled to a single crossed dipole pair dual polarized antenna 115 according to one exemplary embodiment of the invention. The antenna 115, which can transmit and receive electromagnetic signals, comprises a first dipole 205A and a second dipole 205B. The pair of dipoles 205A, 205B are usually positioned orthogonal to one another in order to provide the dual polarization function of the antenna 115 in both the transmit and receive modes of antenna operation. Each dipole 205 can have a resonant length (L) 202 of one-half of an operating wavelength. However, other resonant lengths for the dipoles 205 are not beyond the scope of the invention. Other resonant operating wavelengths include, but are not limited to, one-quarter wavelength and one full wavelength.

In the exemplary embodiment illustrated in FIG. 2, the antenna 115 can comprise photo-etched metal strips that form the dipoles 205A, 205B that are supported by a planar dielectric support 206 made from printed circuit board material. The planar dielectric support 206 can comprise one of many low-loss dielectric materials used in radio circuitry. In one exemplary embodiment, it is made from a material known to one of ordinary skill in the art as 25N (a medium frequency dielectric laminate manufactured by Arlon). 25N is a relatively low-loss material and is fairly inexpensive. The dielectric constant of 25N is approximately 3.25.

However, the invention is not limited to this dielectric constant and this particular dielectric material. Other dielectric constants can fall generally within the range of 2.0 to 6.0. The dielectric support used has a dissipation factor of 0.0024. However, other low-loss type dielectric materials with different dissipation factors are not beyond the scope of the present invention.

Further, it is recognized that the crossed dipole pair dual polarized antenna 115 could be made differently than illustrated and described above. For example, the antenna 115 could be made entirely of metal without the use of printed circuit boards. In such an embodiment (not illustrated), dielectric spacers between respective dipoles 205A, 205B would be needed to maintain separation between respective electrical polarities of each dipole and between the pair 205A, 205B of dipoles.

The invention is not limited to the preferred, yet exemplary crossed dipole pair dual polarized antenna 115 illustrated in FIG. 2. Other radiating antennas include, but are not limited to, monopole, microstrip, slot, and other like antennas.

The feedback system 201 can comprise a feedback element 200 providing for the electrical coupling of feedback signals to and from the radiating crossed dipole pair dual polarized antenna 115. Specifically, the feedback element 200 can be energized by RF signals produced by one or both dipoles 205A, 205B. The feedback element 200 can, in turn, produce feedback signals that are coupled to either or both dipoles 205A, 205B in a manner to cancel out undesired leakage signals, thereby facilitating improvement of the antenna's isolation characteristic.

The feedback element 200 can comprise a conductive planar element. The conductive planar element can be made from a photo-etched metal strip supported by a planar dielectric support (not shown) made from printed circuit board material Feedback elements 200 made from such printed circuit board material can provide a high degree of repeatability and reliability in that the manufacturing of such feedback elements 200 can be precisely controlled. Such feedback elements 200 are conducive for high volume production environments while maintaining high quality standards. The manufacturing processes for such feedback elements 220 provide the advantage of small tolerances. Alternatively, the feedback element 200 could comprise a metal, such as stainless steel. However, other types of metal are not beyond the scope of the invention. Other possible metals include, but are not limited to, copper, aluminum, and other like conductive and ductile metals.

The feedback system 201 includes both the feedback element 200 as well as a fastening mechanism 402. Further details of the fastening mechanism 402 will be described below with respect to FIG. 4.

The feedback element 200 can be precisely positioned along a first imaginary geometrical line 204C that intersects a geometric center 208 of the crossed dipole pair antenna 1 15. The first imaginary geometrical line 204C can be defined by a length dimension of the feedback element 201. Meanwhile, the geometric center 208 of the crossed dipole pair antenna 115 can be defined by the pair of radiators 205A, 205B of the crossed dipole dual polarized antenna.

Specifically, second and third imaginary geometrical lines 204A, 204B may be defined by each length dimension of the pair of radiators 205A, 205B. The intersection of the second and third geometrical lines 204A, 204B defined by length dimensions of the two dipoles 205A, 205B at a ninety degree angle can define the geometric center 208 of the crossed dipole pair antenna 115.

The first geometrical line 204C defined by the length dimension of the feedback element 200 can be positioned at an angle relative to each second and third geometrical lines 204A, 204B defined by the length dimensions of the crossed dipole pair antenna 115. Specifically, the first geometrical line 204C can be positioned at an angle of approximately forty-five degrees relative to the second and third geometrical lines 204B, 204C while the first geometrical line 204C crosses the center 208 of the crossed dipole pair antenna 115.

However, the invention is not limited to the orientation of this preferred, yet exemplary embodiment of the feedback element 200 illustrated in FIG. 2. Other orientations of the feedback element 200 are illustrated and discussed in further detail below in connection with FIGS. 6A-6D.

The feedback element 200 can have an extended "C" shape in which a middle portion of the "C" shape can be substantially linear in shape. The "C" shaped feedback element 200 can be a concaved geometry in which the opening of the "C" shape opens towards the crossed dipole pair, dual polarized antenna. Each end of the linear middle portion of the "C" shape feedback element may include an element that extends at an angle, such as a forty-five degree angle, relative to the substantially linear middle portion of the "C" shape. The "C" shape element can be oriented such that the ends of the "C" shape.

However, the invention is not limited to the "C" shape of this preferred, yet exemplary embodiment of the feedback element 200 illustrated in FIG. 2. Other shapes of the feedback element 200 are illustrated and discussed in further detail below in connection with FIGS. 7A-7J.

Figure 3A:
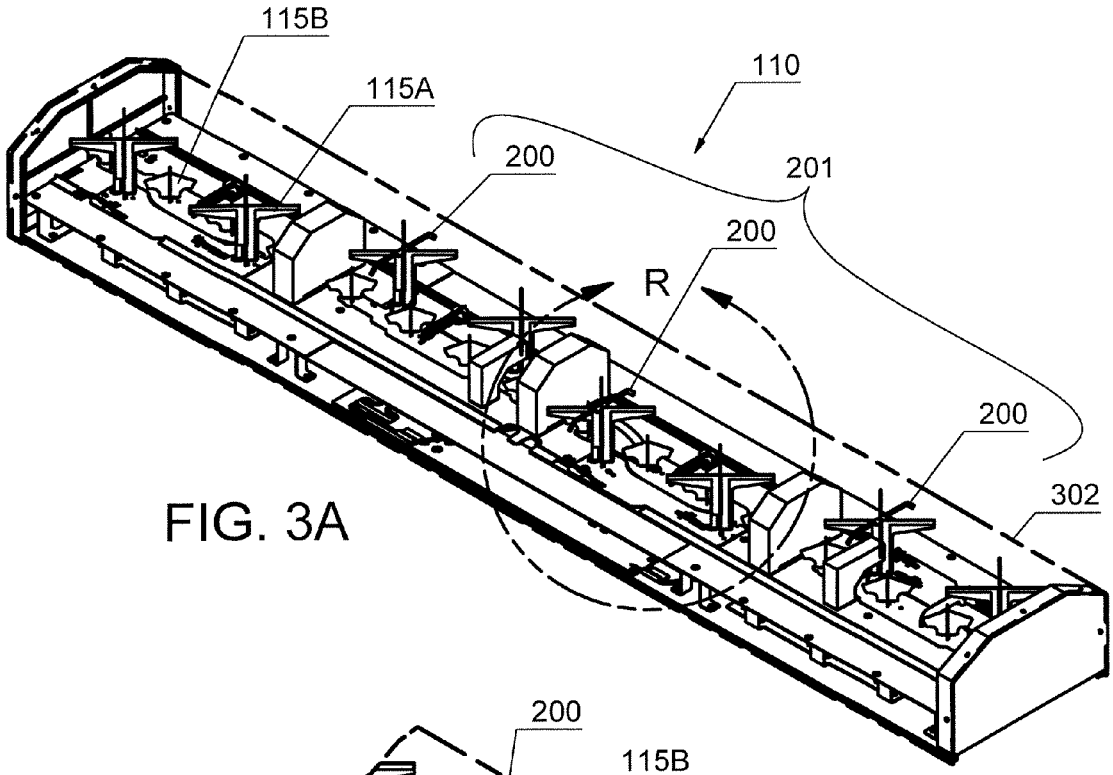
FIG. 3A is an isometric view of an exemplary feedback system coupled to multiple crossed dipole pair dual polarized antennas in a dual band antenna array according to one exemplary embodiment of the invention.

Referring now to FIG. 3A, this figure is an isometric view of an exemplary feedback system 201 coupled to multiple crossed dipole pair dual polarized antennas 115A in a dual band antenna array 110 according to one exemplary embodiment of the invention. In this exemplary embodiment, the feedback system 201 includes three feedback elements 200 coupled to three crossed dipole pair dual polarized antennas 115A that operate in a low frequency band relative to crossed dipole pair dual polarized antennas 115B that operate in a high frequency band. One of ordinary skill in the art recognizes that low frequency band antennas 115A have a physical size that is greater than the high frequency band antennas 115B.

The low frequency band antennas 115A can operate in a frequency range that provides service for the Advanced Mobile Phone System (AMPS). This AMPS frequency range can be between 806 and 896 MHz. Meanwhile, the high frequency band antennas 115B can support Personal Communications Services (PCS) that have a frequency range between 1850 and 1990 MHz.

The linear array 110 can comprise eight low frequency band antenna elements 115A and sixteen high frequency band antenna elements 115B. The overall dimensions, including a radome 302 shown with dashed lines, can be approximately 72 by 12 by 7.5 (length, width, height) inches. However, other dimensions and other operational frequency bands for the linear antenna array 110 are not beyond the scope of the invention.

Figure 3B:
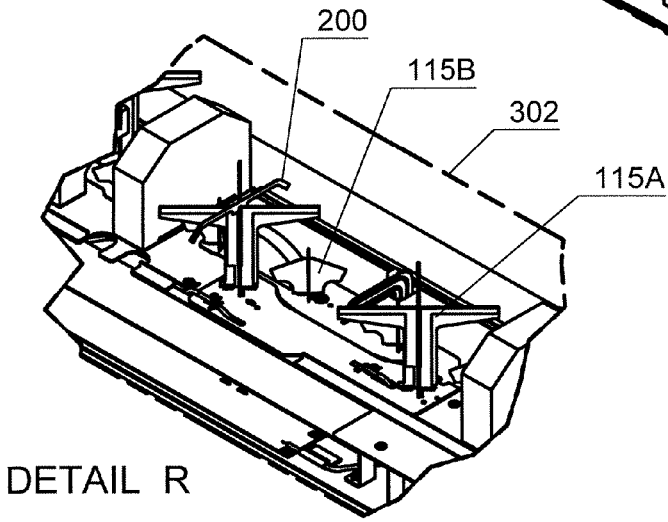
FIG. 3B is an enlarged view of a portion of the exemplary feedback system illustrated in FIG. 3A.

Referring now to FIG. 3B, this figure is an enlarged view of a portion of the exemplary feedback system 201 illustrated in FIG. 3A. This figure illustrates that only a few crossed dipole pair dual polarized antennas 115A were selected to have the feedback element 200. The feedback elements 200 of the linear array 110 were observed to have no significant affect on the performance of the high frequency band antennas 115B. That is, the feedback elements 200 did not degrade or significantly improve the performance of the high frequency band antennas 115B. However, a significant improvement in isolation for the low frequency band antennas 115A was observed.

The significant improvement in isolation for the low frequency band antennas 115A illustrated in FIGS. 3A and 3B is discussed in further detail below in connection with FIG. 8. In the exemplary embodiment illustrated in FIGS. 3A and 3B, the "C" shape of the feedback element 200 can be aligned with the "C" shape of the radome 302. In other words, the radome 302 can also be characterized as having a "C" shape that is similar to the "C" shape of the feedback elements 200. According to this exemplary embodiment, the crossed dipole pair dual polarized antennas 115A are oriented in such a way so that the "C" shape of the feedback elements 200 are in parallel alignment with the "C" shape of the radome 302. This orientation as well as the number of feedback elements 200 and the selection of the antennas 115A to support the feedback elements 200 was determined empirically and after several trials.

To determine the orientation, number, and selection of the feedback elements 200 through theoretical calculations of any antenna array is recognized to one of ordinary skill in the art to be too difficult and too time consuming. The number of variables in simulation models for an antenna array is too great for even the most robust computers to handle. The number of variables can be attributed to the electromagnetic coupling that occurs between metal elements in any antenna array when calculating values in the near field.

Other alignments and number of the feedback elements 200 are possible and are not beyond the scope of the invention. However, it was discovered that orientation of the feedback elements, their number, and the specific antennas 115A that were selected to support the feedback elements 200 for the linear antenna array 110 illustrated in FIGS. 3A and 3B provided a significant and unexpected improvement or result for the isolation characteristic of the antenna array 110. Further details about this degree of unexpected improvement or result for the isolation characteristic of the antenna array 110 of FIGS. 3A and 3B is discussed below in connection with FIG. 8.

Empirical measurements can be conducted to determine the proper number of feedback elements 200 and the proper orientation of each relative to the antennas 115 to obtain a feedback signal having the appropriate amplitude so as to achieve the complete cancellation of a leakage signal at an antenna array 110. By "tuning" the antenna with the appropriate amount of coupling, a feedback signal having the correct amplitude will be produced which, in turn, will result in the desired amount of isolation being achieved within the antenna system.

This tuning is a function of the feedback element geometry, height, and spacing of the feedback elements 200 relative to adjacent antennas 115. Ultimately, the actual parameters of the feedback elements 200 will depend upon the particular application at hand to generate a strength or amplitude of feedback signal needed to cancel out any leakage signals at ports of an antenna array.

Each feedback signal contributes to the generation of an aggregate feedback signal having the desired amplitude and phase characteristics. Thus, when the two feedback signals sum with the leakage signal at separate two or more connection ports of an antenna, the leakage signals are canceled by the 180 degree phase difference of the feedback signals generated by the feedback elements.

Figure 4A:
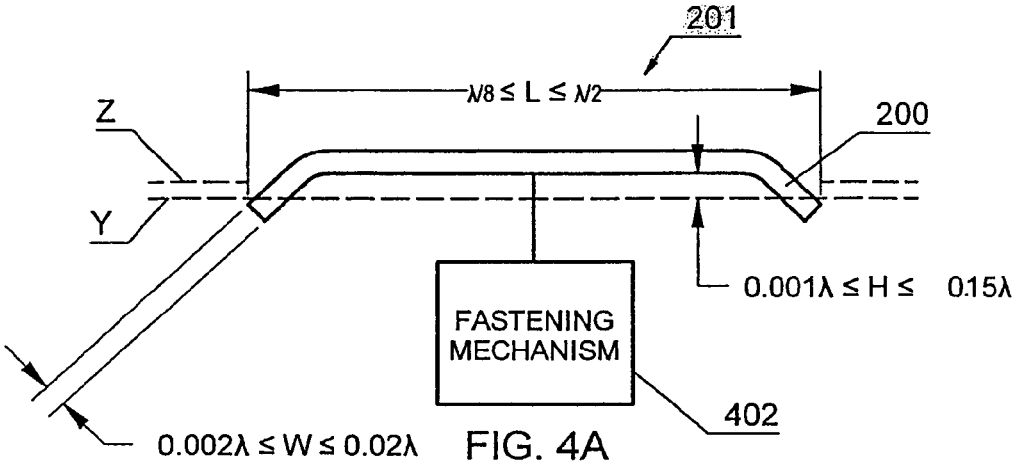
FIG. 4A is a side view that illustrates a length dimension combined with a functional block diagram of a fastening mechanism of an exemplary feedback system according to one exemplary embodiment of the invention.

Referring now to FIG. 4A, this figure is a side view that illustrates a length dimension L combined with a functional block diagram of a fastening mechanism 402 of an exemplary feedback system 201 according to one exemplary embodiment of the invention. The fastening mechanism 402 couples the feedback element 200 to the crossed dipole pair dual polarized antenna 115 (not illustrated in FIG. 4A). The fastening mechanism 402 can comprise various different structures as will be explained in further detail below with respect to FIG. 5. The fastening mechanism can include, but is not limited to, structures extending from the feedback element 201; structures extending from the antenna 115; adhesives; mechanical fasteners such as rivets, screws, nails, staples, bolts, screws, etc.; any combination of the aforementioned structures; and other like structures. One of ordinary skill in the art recognizes that the fastening mechanism 402 is preferably made of non-conductive materials so that the fastening mechanism 402 does not affect the radiation characteristics of the antenna 1 15.

The fastening mechanism 402 of the inventive feedback system 200 can include materials that permit a high degree of control over the material properties of the fastening mechanism 402. Each fastening mechanism 402 can include an insulative material that has electrical and mechanical properties that are conducive to extreme operating environments of antenna arrays. For example, such fastening mechanisms can be selected to provide appropriate dielectric constants (relative permeability), loss tangent (conductivity), and coefficient of thermal expansion in order to optimize the isolation between respective antenna elements 115 in an antenna array 110.

FIG. 4A further illustrates the positioning of the feedback element 200 relative to a plane defined by the second and third geometrical lines 204A, 204B (of FIG. 2) of the crossed dipole pair dual polarized antenna 115. The spacing between a substantially linear portion of the feedback element 200 and the geometric plane defined by the second and third geometrical lines 204A, 204B can be between approximately one-thousandths (0.001) and fifteen-hundredths (0.15) of a wavelength at an operating frequency of the crossed dipole pair, dual polarized antenna. In other words, the feedback element 200 is positioned by the fastening mechanism 402 so that it can "float" above the crossed dipole pair dual polarized antenna 115 at a distance of between approximately 0.001 and 0.15 of a wavelength at an operating frequency of the crossed dipole pair, dual polarized antenna 115. One of ordinary skill in the art recognizes that other magnitudes of the spacing between the feedback element 200 and the antenna 115 are not beyond the scope of the invention.

FIG. 4A further illustrates a length L and width W of the feedback element 200. The length L of the feedback element 200 can be between approximately one-eighth and one-half of a wavelength of the operating frequency of the crossed dipole pair antenna. The feedback element 200 can have a width dimension W of between approximately two-thousandths (0.002) and two-hundredths (0.02) of a wavelength at an operating frequency of the antenna. According to the exemplary embodiments illustrated, the feedback element 200 can have a length L, width W, and thickness T (FIG. 4B) wherein the length L and width W are larger than the thickness T. One of ordinary skill in the art recognizes that other magnitudes of the length L and the width W are not beyond the scope of the invention.

Figure 4B:
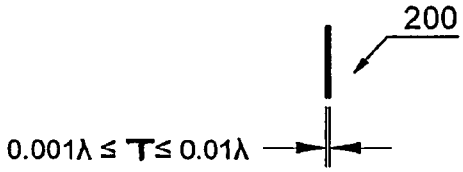
FIG. 4B is a side view of an exemplary feedback system that illustrates a thickness dimension according to one exemplary embodiment of the invention.

Referring to FIG. 4B, this figure is a side view of an exemplary feedback system 201 that illustrates a thickness dimension T of the feedback element 200 according to one exemplary embodiment of the invention. The feedback element 200 can have thickness dimension T of between approximately one-thousandths (0.001) and one-hundredth (0.01) of a wavelength at an operating frequency of the antenna. One of ordinary skill in the art recognizes that other magnitudes of thickness T are not beyond the scope of the invention.

Figure 5A:
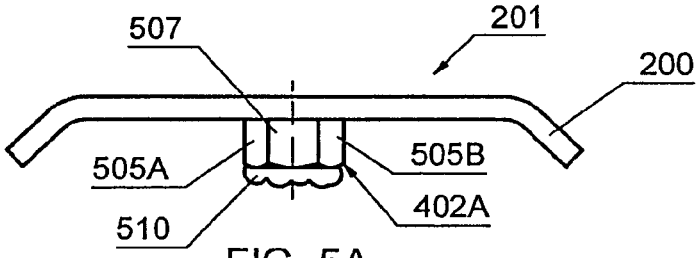
FIG. 5A is a side view of an exemplary feedback system with a fastening mechanism of tabs forming a groove and an adhesive according to one exemplary embodiment of the invention.

Referring now to FIG. 5A, this figure is a side view of an exemplary feedback system 201 with a fastening mechanism 402A of tabs 505 forming a groove 507 and an adhesive 510 according to one exemplary embodiment of the invention. The tabs 505 can be positioned on either side of the center 208 of the "cross" formed by the crossed dipoles 205A, 205B (FIG. 2). The groove 507 formed by the tabs 505A, 505B can receive portions of the dielectric support of the crossed dipoles 205A, 205B. An adhesive 510 such as an epoxy can be used to keep the groove 507 and tabs 505 in a fixed position relative to the crossed dipole pair dual polarized antenna 115. This particular embodiment of the feedback system 201 allows for high volume and rapid manufacturing of the feedback system 201 with precise placement of the feedback system 201 relative to the antenna 115. In one exemplary embodiment, the epoxy can be Devcon 5-minute epoxy, which is suitable for rapid manufacturing. One of ordinary skill in the art recognizes that almost any non-metallic glue can be used.

Figure 5B:
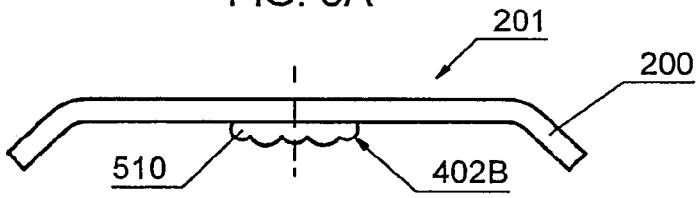
FIG. 5B is a side view of an exemplary feedback system with a fastening mechanism of an adhesive according to one exemplary embodiment of the invention.

Referring now to FIG. 5B, this figure is a side view of an exemplary feedback system 201 with a fastening mechanism 402 of an adhesive 510 according to one exemplary embodiment of the invention. According to this exemplary embodiment, the fastening mechanism only includes or consists of the adhesive 510 that can be positioned at a center portion of the feedback element 200. The adhesive 510 can physically connect the feedback element 200 to the dielectric support 206 (not illustrated, but see FIG. 2) of the crossed dipole pair dual polarized antenna 115.

Like the exemplary embodiment of FIG. 5A, this particular embodiment of the feedback system 201 of FIG. 5B allows for high volume and rapid manufacturing of the feedback system 201 with precise placement of the feedback system 201 relative to the antenna 115. According to this exemplary embodiment, a sufficient amount of adhesive 510 can be supplied to support and fasten the feedback element 200 to the crossed dipole pair, dual polarized antenna 115 alone without any additional mechanical elements.

Figure 5C:
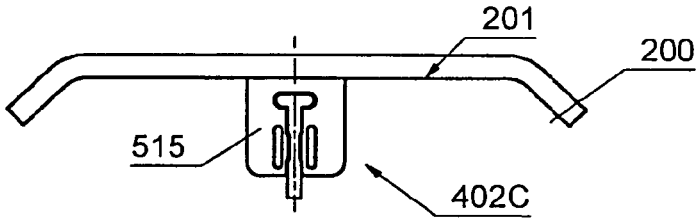
FIG. 5C is a side view of an exemplary feedback system with a fastening mechanism of a spring according to one exemplary embodiment of the invention.

Referring now to FIG. 5C, this figure is a side view of an exemplary feedback system 201 with a fastening mechanism 402C of a spring 515 according to one exemplary embodiment of the invention. Specifically, spring feet 515 that are milled out of the feedback element 200 itself. These spring feet 515 can snap the feedback element 200 into place on the center 208 of the crossed dipole pair, dual polarized antenna 115. The spring feet can contact the center portion 208 of the crossed dipole pair, dual polarized antenna 115.

Figure 5D:
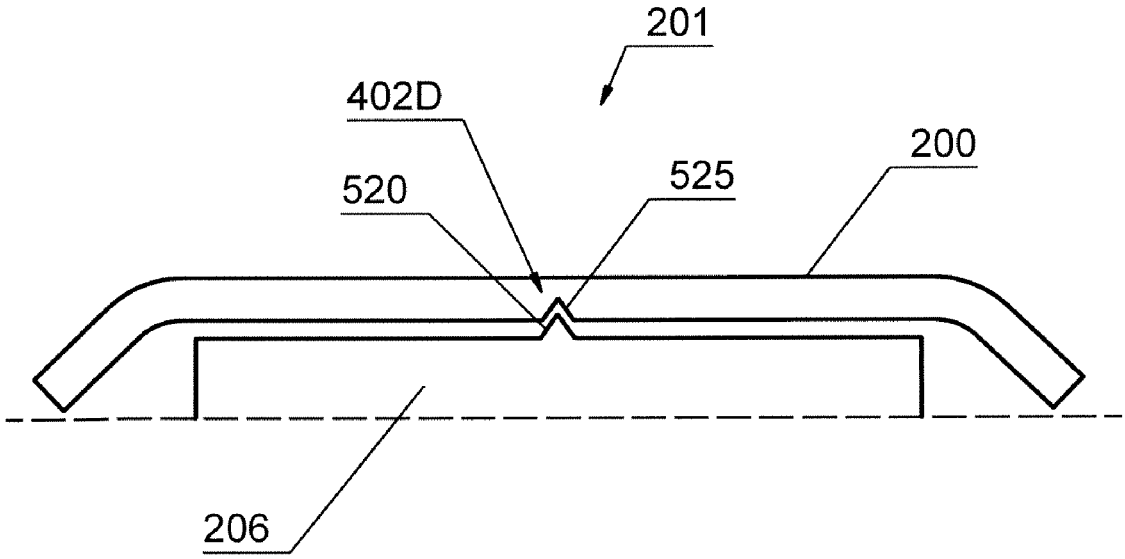
FIG. 5D is a side view of an exemplary feedback system with a fastening mechanism of a dielectric extension and a groove within the feedback element according to one exemplary embodiment of the invention.

Referring now to FIG. 5D, this figure is a side view of an exemplary feedback system 201 with a fastening mechanism 402D of a dielectric extension 520 and a groove 525 according to one exemplary embodiment of the invention. The groove can be formed within the feedback element 200. The dielectric extension 520 can be formed from the dielectric material 206 that is used to support the metallic elements of the crossed dipole pairs 205A, 205B of the dual polarized antenna 115. The fastening mechanism 402D of FIG. 5D can also include an adhesive (not illustrated) to hold the groove 525 of the feedback element in place over the extension 520 of the dielectric material 206.

Figure 6A:
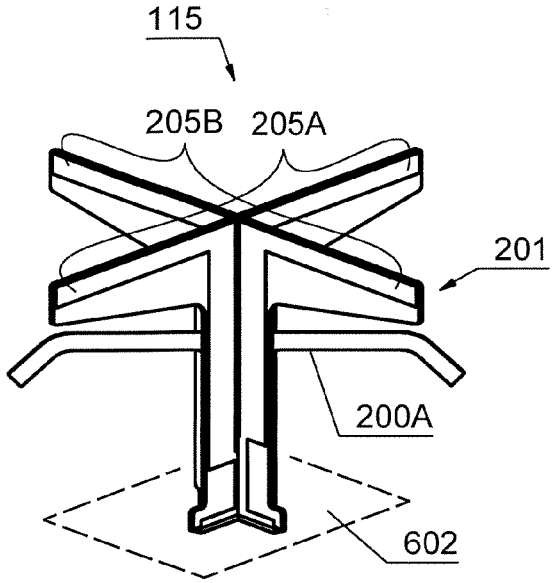
FIG. 6A is an isometric view of an exemplary feedback system coupled to a crossed dipole pair dual polarized antenna in which conductive planar strips are positioned between the radiating dipoles and a ground plane according to one exemplary embodiment of the invention.

Referring now to FIG. 6A, this figure is an isometric view of an exemplary feedback system 201 coupled to a crossed dipole pair dual polarized antenna 115 in which conductive planar strips 200A are positioned between the radiating dipoles 205A, 205B and a ground plane 602 according to one exemplary embodiment of the invention. The planar strips 200 can be attached to the center portions of the dielectric material 206 of the radiating dipoles 205A, 205B. The fastening mechanism 402 (not illustrated) can include any one of the embodiments discussed above, such as, but not limited to, an adhesive.

Figure 6B:
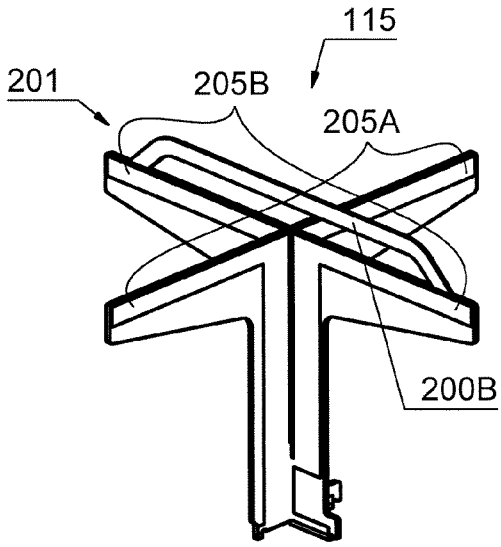
FIG. 6B is an isometric view of an exemplary feedback system coupled to a crossed dipole pair dual polarized antenna in which a feedback element is in parallel alignment with one dipole of the crossed dipole pair dual polarized antenna according to one exemplary embodiment of the invention.

Referring now to FIG. 6B, this figure is an isometric view of an exemplary feedback system 201 coupled to a crossed dipole pair dual polarized antenna 115 in which a feedback element 200B of a conductive planar strip is in parallel alignment with a one dipole 205B of the crossed dipole pair according to one exemplary embodiment of the invention. Specifically, the feedback element 200B is in parallel alignment with a length dimension of one of the dipoles 205B.

Figure 6C:
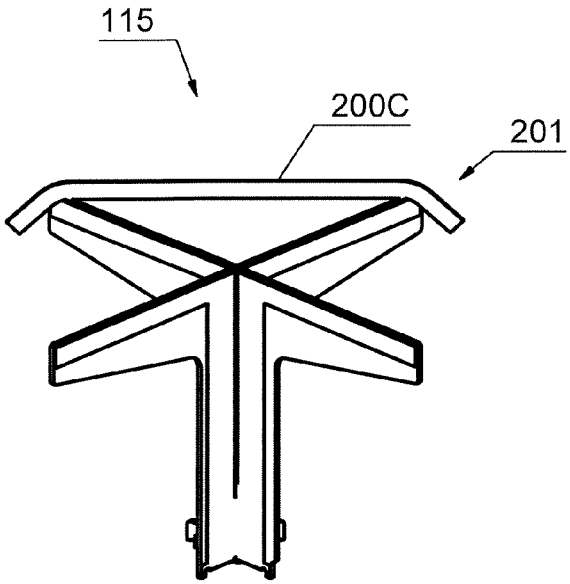
FIG. 6C is an isometric view of an exemplary feedback system coupled to a crossed dipole pair dual polarized antenna in which a feedback element of a conductive planar strip is positioned along ends of opposite dipoles of the crossed dipole pair dual polarized antenna according to one exemplary embodiment of the invention.

Referring now to FIG. 6C, this figure is an isometric view of an exemplary feedback system 201 coupled to a crossed dipole pair dual polarized antenna 115 in which a feedback element 200C of conductive planar strip is positioned along ends of opposite dipoles 205A, 205B of a crossed dipole pair dual polarized antenna 115 according to one exemplary embodiment of the invention. Specifically, the feedback element 200C can be fastened to ends of opposite sets of dipoles 205A, 205B. The fastening mechanism 402 (not illustrated) can include anyone of the embodiments discussed above, such as, but not limited to, an adhesive.

Figure 6D:
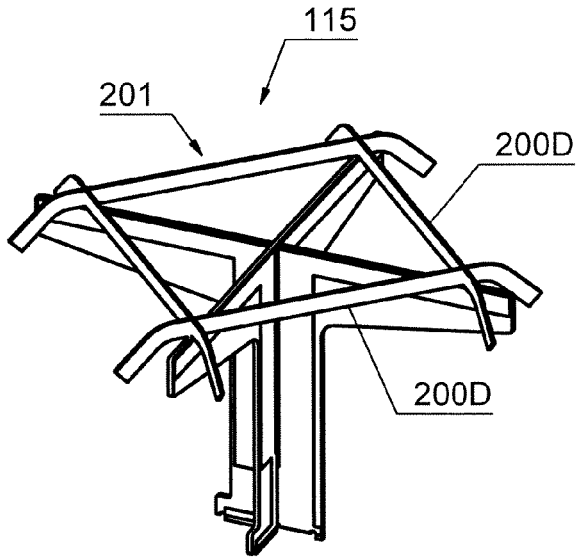
FIG. 6D is an isometric view of an exemplary feedback system coupled to a crossed dipole pair dual polarized antenna in which four feedback elements are positioned along ends of each of the radiating dipole pairs according to one exemplary embodiment of the invention.

Referring now to FIG. 6D, this figure is an isometric view of an exemplary feedback system 201 coupled to a crossed dipole pair dual polarized antenna 115 in which four feedback elements 200D are positioned along ends of each of the radiating dipoles 205A, 205B of the crossed dipoles according to one exemplary embodiment of the invention. Specifically, the four feedback elements 200D can be attached at their respective ends to form a substantially square shape. Meanwhile, the crossed dipoles 205A, 205B form an "X" shape that intersects and supports the four feedback elements 200D at the corners of the square shape. The fastening mechanism 402 (not illustrated) for the four feedback elements 200D can include any one of the embodiments discussed above, such as, but not limited to, an adhesive.

Figure 6E:
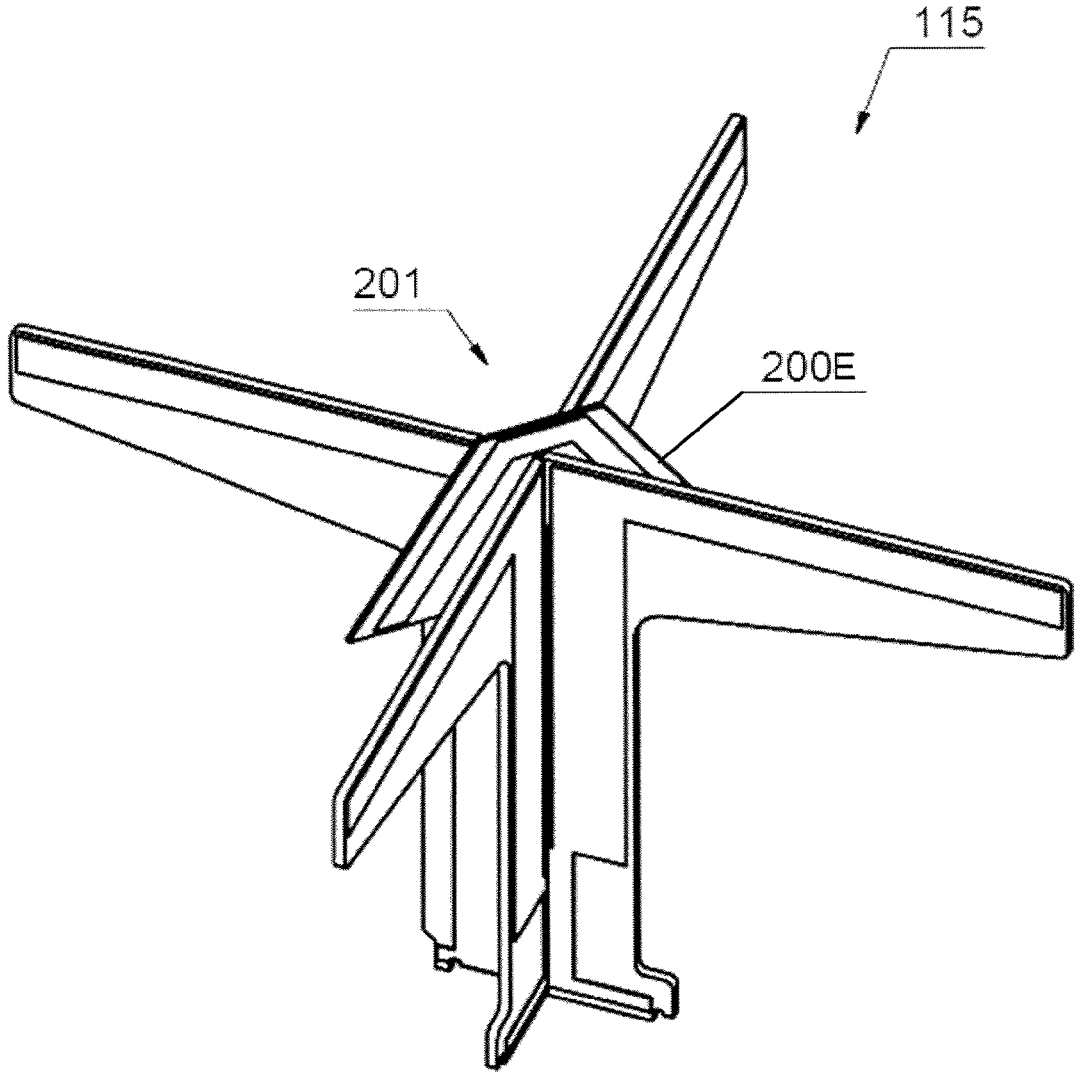
FIG. 6E is an isometric view of an exemplary feedback system coupled to a crossed dipole pair dual polarized antenna in which the feedback element is positioned at an angle relative to geometric directions defined by each of the radiating dipoles according to one exemplary embodiment of the invention.

Referring now to FIG. 6E, this figure is an isometric view of an exemplary feedback system 201 coupled to a crossed dipole pair dual polarized antenna 115 in which the feedback element 200E is positioned at an angle relative to geometric directions defined by each of the radiating dipoles. The feedback element 200E can have an inverted, flat "V" shape in this exemplary embodiment. The fastening mechanism 402 (not illustrated) for the feedback element 200E can include any one of the embodiments discussed above, such as, but not limited to, an adhesive.

Figure 6F:
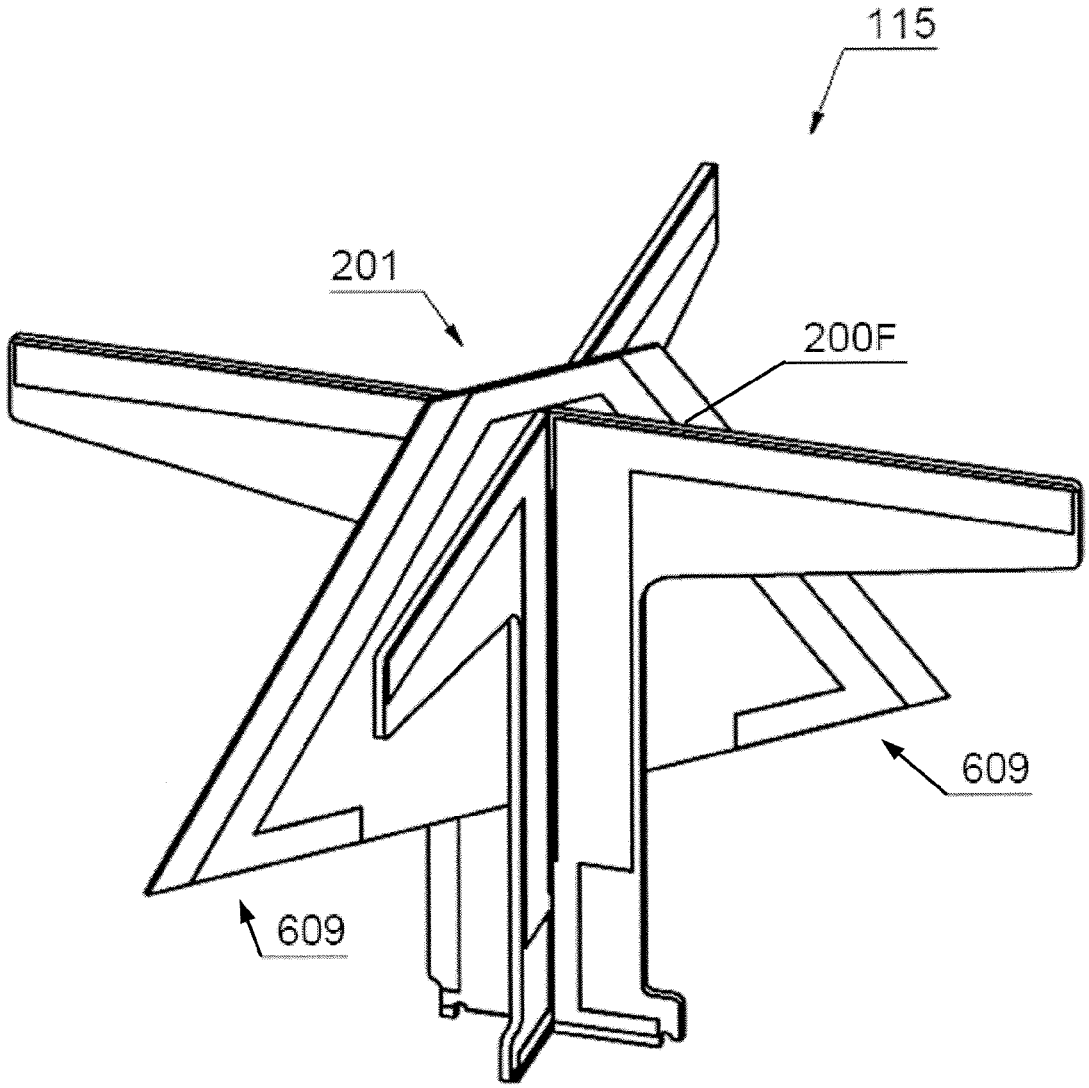
FIG. 6F is an isometric view of an exemplary feedback system coupled to a crossed dipole pair dual polarized antenna in which the feedback element is positioned at an angle relative to geometric directions defined by each of the radiating dipoles and extends significantly below a geometric plane defined by the edges of the radiating dipoles according to one exemplary embodiment of the invention.

Referring now to FIG. 6F, this figure is an isometric view of an exemplary feedback system 201 coupled to a crossed dipole pair dual polarized antenna 115 in which the feedback element 200F is positioned at an angle relative to geometric directions defined by each of the radiating dipoles and extends significantly below a geometric plane defined by the edges of the radiating dipoles. The feedback element 200F can have an inverted, flat "V" shape. The flat "V" shape in this exemplary embodiment also has portions 609 that extend from the "V" shape that define acute angles. The fastening mechanism 402 (not illustrated) for the feedback element 200F can include any one of the embodiments discussed above, such as, but not limited to, an adhesive.

Figure 6G:
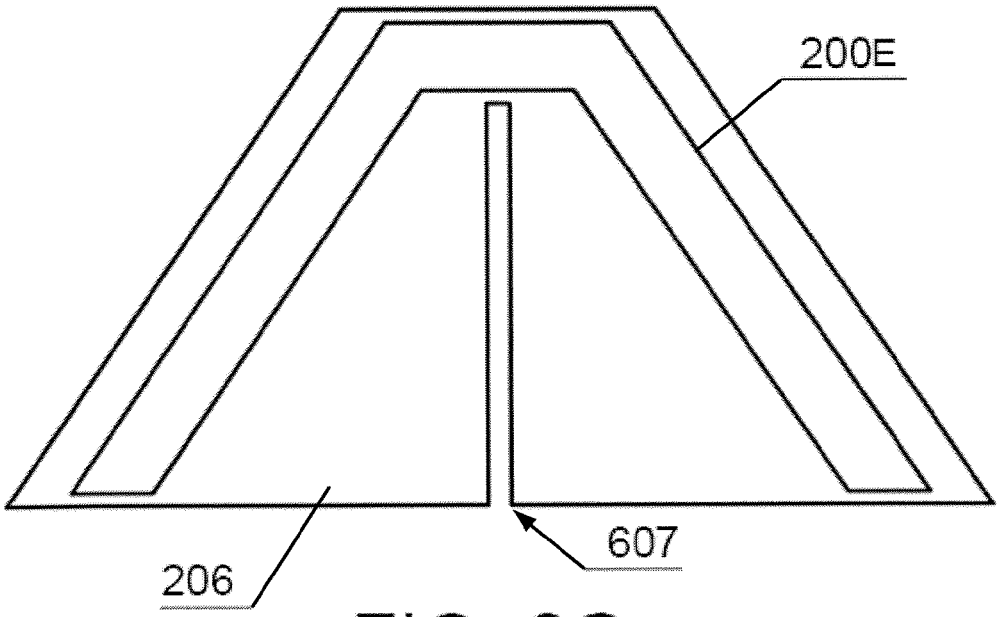
FIG. 6G is a side view of the exemplary feedback element illustrated in FIG. 6E.

Referring now to FIG. 6G, this figure is a side view of the exemplary feedback element 200E illustrated in FIG. 6E. As noted above, the feedback element 200E can have an inverted, flat "V" shape in this exemplary embodiment. The fastening mechanism 402 (not illustrated) for the feedback element 200E can include any one of the embodiments discussed above, such as, but not limited to, an adhesive. The fastening mechanism 402 further includes a slot 607 that can be used to position the feedback element 200E across a radiating dipole.

Figure 6H:
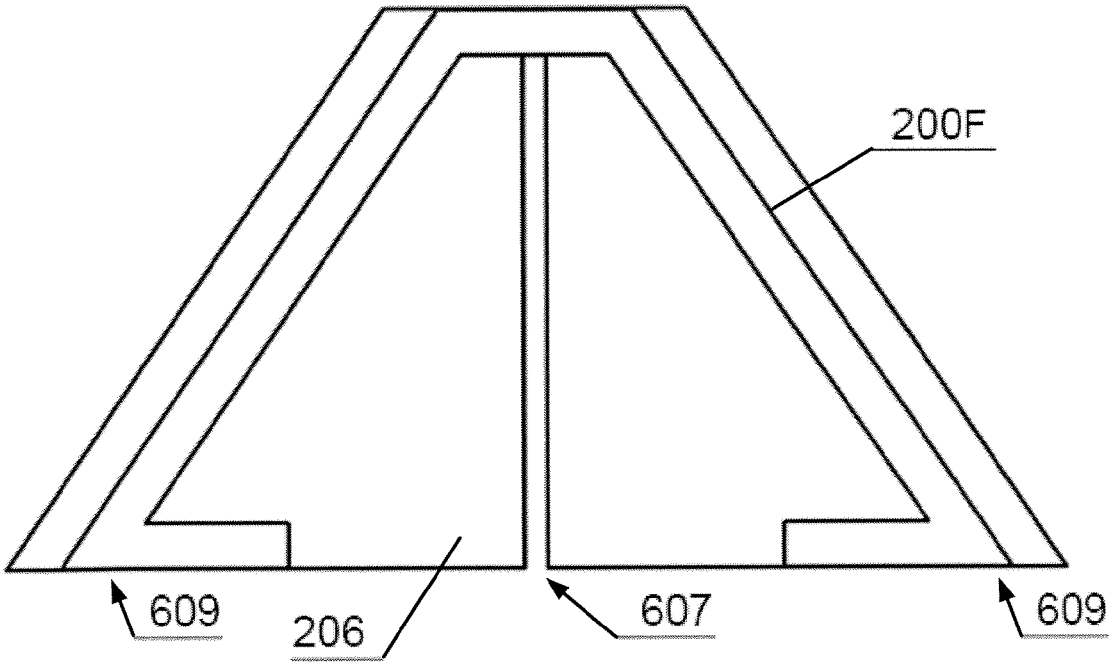
FIG. 6H is a side view of the exemplary feedback element illustrated in FIG. 6F.

Referring now to FIG. 6H, this figure is a side view of the exemplary feedback element 200F illustrated in FIG. 6F. As noted above, the feedback element 200F can have an inverted, flat "V" shape in this exemplary embodiment along with acute angle portions 609. The fastening mechanism 402 (not illustrated) for the feedback element 200F can include any one of the embodiments discussed above, such as, but not limited to, an adhesive. The fastening mechanism 402 further includes a slot 607 that can be used to position the feedback element 200F across a radiating dipole. Relative to FIG. 6G, the feedback element 200F in this exemplary embodiment can be positioned closer to the slot 607.

Figure 7A:
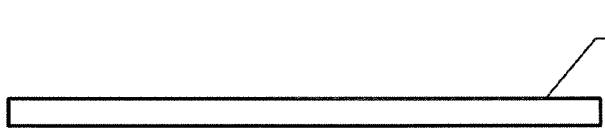
FIGS. 7A-7J are side views of exemplary feedback elements with various different geometries according to exemplary embodiments of the invention.
Figure 7B:
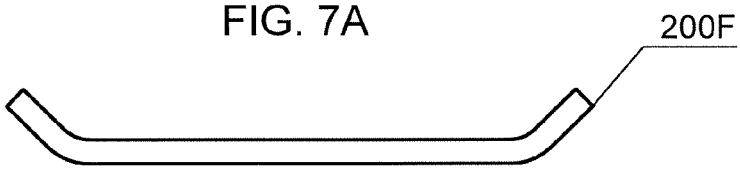

Referring now to FIGS. 7A-7J, these figures illustrate side views of exemplary feedback elements 200E-200N with various different geometries according to exemplary embodiments of the invention. Referring to FIG. 7A, this figure illustrates a feedback element 200E with a substantially rectilinear shape. FIG. 7B illustrates a feedback element 200F with a "C" shape where the opening of the "C" shape is designed to face away from the crossed dipole pair dual polarized antenna 115 (not illustrated).

Figure 7C:
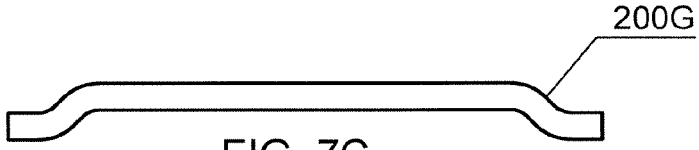
Figure 7D:
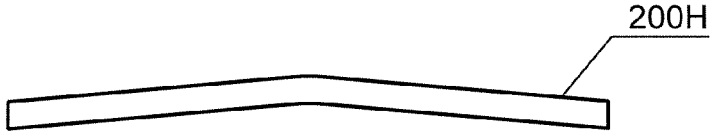

Referring now to FIG. 7C, this figure illustrates a feedback element 200G with a substantially linear midsection and a set of curved ends. FIG. 7D illustrates a feedback element 200H with a flat "V" shape in which the apex of the "V" shape is designed to open or face the crossed dipole pair dual polarized antenna 115 (not illustrated).

Figure 7E:
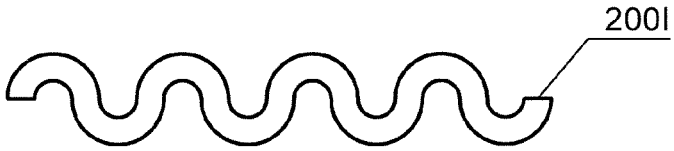
Figure 7F:
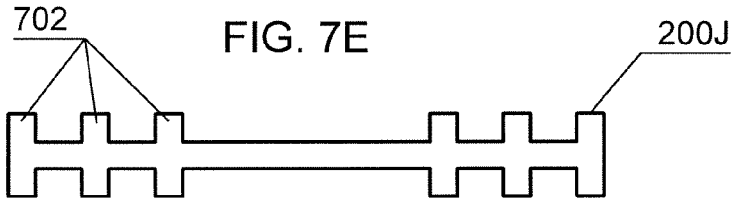
Figure 7G:
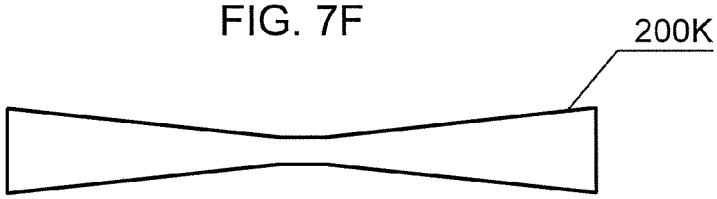

FIG. 7E illustrates a feedback element 200I with a sinusoidal or wavy shape in which several "U" shaped elements are linked with one another in a repeating cycle. FIG. 7F illustrates a feedback element 200J with a rectilinear shape combined with multiple stubs or rectangular projections 702. FIG. 7G illustrates a feedback element 200K with a bow tie shape in which the ends of the bow tie shape have width that is greater than a center portion of the bow tie shape.

Figures 7H, 7I, 7J:
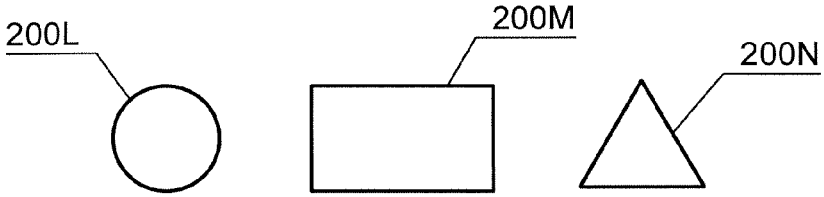

FIG. 7H illustrates a feedback element 200L with a substantially circular shape while FIG. 7I illustrates a feedback element 200M with a substantially rectangular shape. And FIG. 7J illustrates a feedback element 200N with a substantially triangular shape. The circular, rectangular, and triangular shapes illustrated in FIGS. 7H-7I may have widths that approach or are exactly equal to their lengths. Meanwhile, the shapes illustrated in FIGS. 7A-7F may have width dimensions that are substantially constant throughout a respective geometry.

Figure 8:
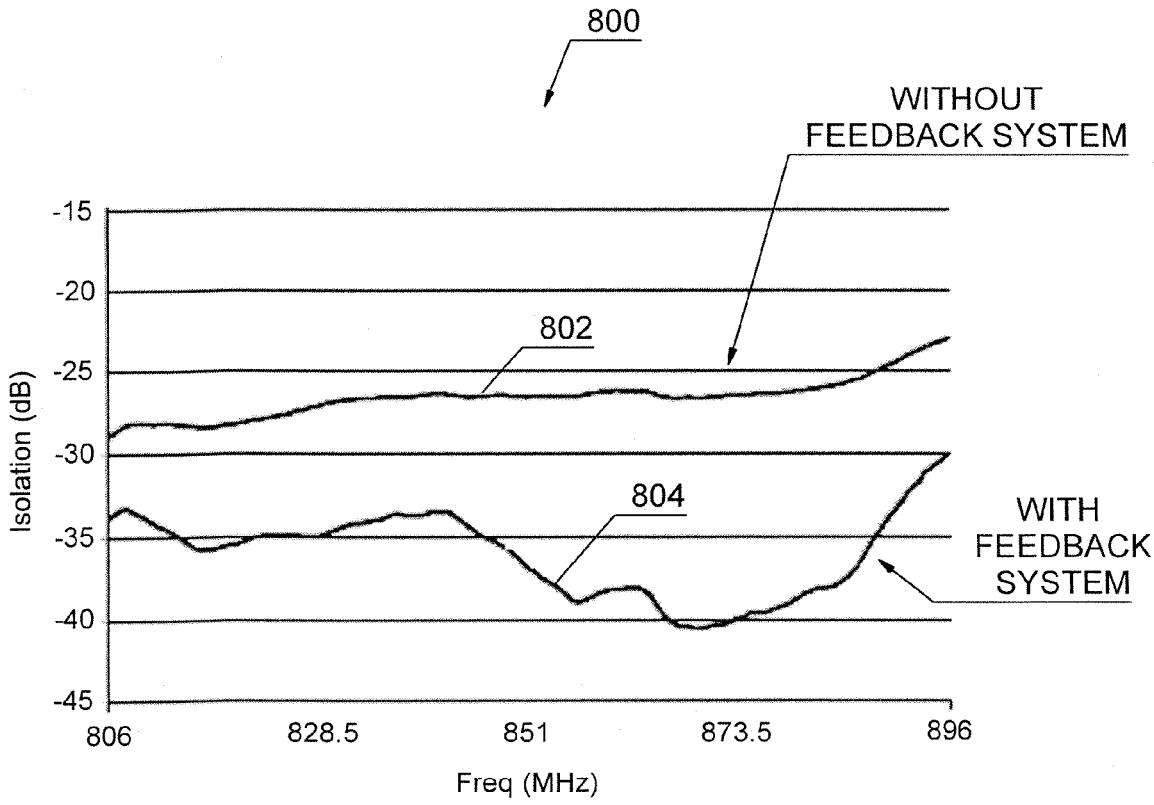
FIG. 8 is a graph illustrating the isolation characteristic of a dual band antenna array made of crossed dipole pair dual polarized antenna elements with a feedback system compared to an antenna array without a feedback system according to one exemplary embodiment of the invention.

Referring now to FIG. 8, this figure is a graph illustrating the isolation characteristic of a dual band antenna array 110 made of crossed dipole pair dual polarized antenna elements 115A, 115B with a feedback system 201 compared to an antenna array 110 without a feedback system 201 according to one exemplary embodiment of the invention. The graph 800 plots an isolation characteristic measured in decibels along the Y-axis against operating frequency measured in Megahertz on the X-axis. The frequency range along the X-axis is between 806 MHz and 896 MHz which is the AMPS frequency band.

The top data line 802 of graph 800 illustrates actual measured data for an antenna array 110 similar to the one illustrated in FIG. 3A but without any feedback system 201. The antenna array 110 that produced the top data line 802 had eight low frequency band antennas 115A and sixteen high frequency band antennas 115B. The high frequency band antennas were operated in the PCS frequency band (between 1850 and 1990 MHz). The overall dimensions including a radome were 72 by 12 by 7.5 (length, width, height) inches. The data line 802 has a first data point of approximately −29 dB at 806 MHz and a last data point −23 dB at 896 MHz.

Meanwhile, bottom data line 804 illustrates actual measured data for an antenna array 110 similar to the one illustrated in FIG. 3A but with the feedback system 201 of the invention also similar to the one illustrated in FIG. 3A in which three low frequency antennas 115A had feedback elements 200. The antenna array 110 that produced the bottom data line 804 had eight low frequency band antennas 115A and sixteen high frequency band antennas 115B. The high frequency band antennas were operated in the PCS frequency band (between 1850 and 1990 MHz). The overall dimensions including a radome were 72 by 12 by 7.5 (length, width, height) inches.

The bottom data line 804 has a first data point of approximately −34 dB at 806 MHz and a last data point −30 dB at 896 MHz. But the average between these two data points is about −36 dB. This improvement of 30 dB and greater is unexpected. While some improvement in performance would be anticipated to one of ordinary skill in the art, achieving 30 dB and greater for an isolation characteristic of an antenna array 110 as described above was unexpected. Other performance parameters of the antenna array 110 such as return loss and radiation pattern shape were not found to be adversely affected by the feedback system 201. In some cases, these other parameters were actually improved.

Figure 9:
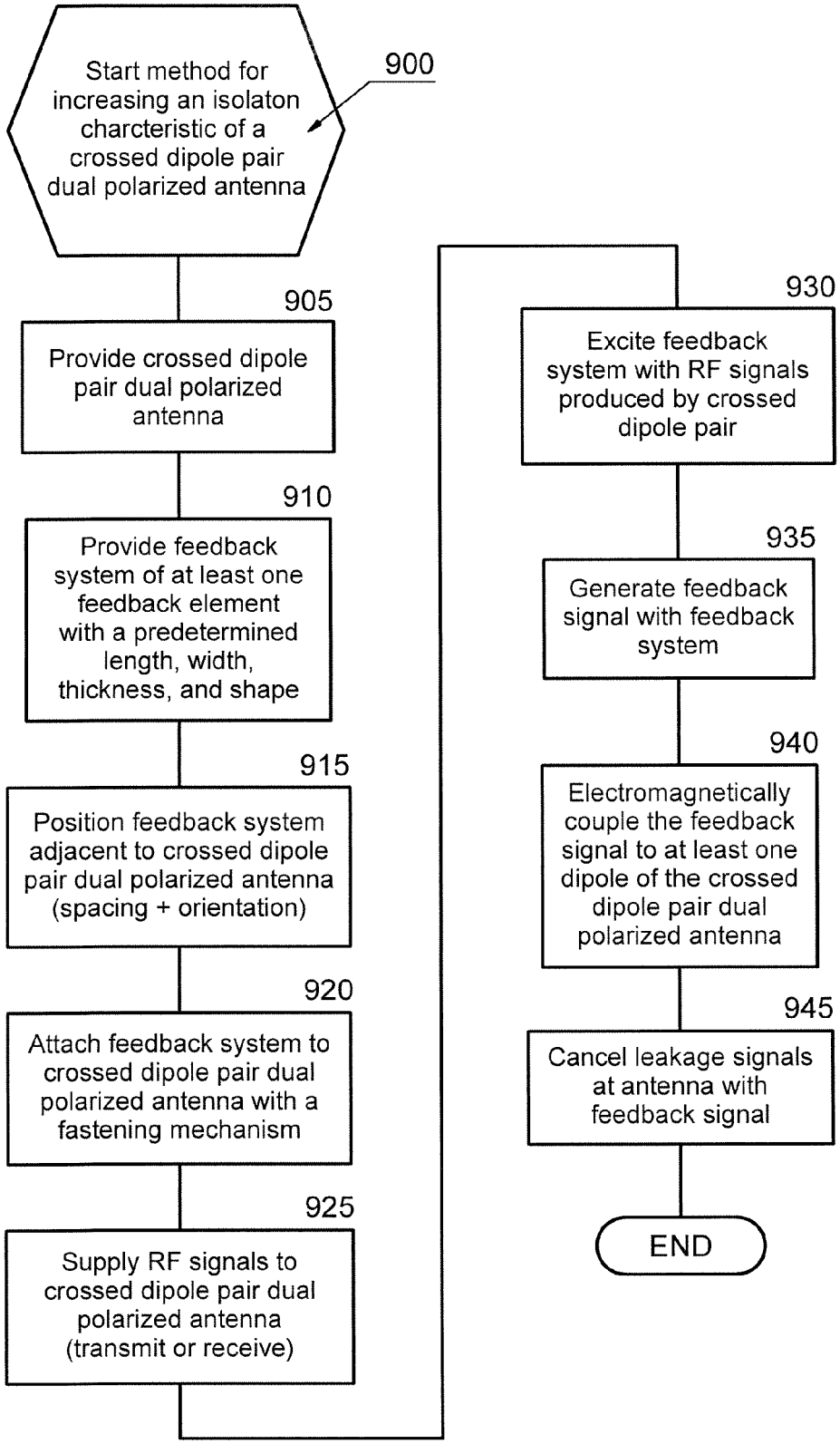
FIG. 9 is a flow chart illustrating exemplary steps for increasing an isolation characteristic of a crossed dipole pair dual polarized antenna according to one exemplary embodiment of the invention.

Referring now to FIG. 9, this figure is a flow chart illustrating exemplary steps of a method 900 for increasing an isolation characteristic of a crossed dipole pair dual polarized antenna 115 according to one exemplary embodiment of the invention. Certain steps in the processes or process flow described below must naturally precede others for the invention to function as described. However, the invention is not limited to the order or number of the steps described if such order or sequence does not alter the functionality of the invention. That is, it is recognized that some steps may be dropped entirely or that they may be performed before or after or in parallel with other steps without departing from the scope and spirit of the invention.

Step 905 is the first step of the process or method 900 in which a crossed dipole pair dual polarized antenna 115 is provided. As noted above, other types of antennas are not beyond the scope of the invention, however, a preferred and exemplary embodiment of the antenna is the crossed dipole pair dual polarized antenna 115.

Next in step 910, a feedback system 201 of at least one feedback element 200 that may comprise a conductive planar strip can be provided. The feedback element 200 can have a predetermined length, width, thickness, and shape as described above in connection with FIGS. 4A-4B. For example, the length L of the feedback element 200 can be between approximately one-eighth and one-half of a wavelength of the operating frequency of the crossed dipole pair antenna 115. The feedback element 200 can have a width dimension W of approximately 0.014 of a wavelength at an operating frequency of the antenna. According to the exemplary embodiments illustrated, the feedback element 200 can have a length L, width W, and thickness T (FIG. 4B) wherein the length L and width W are larger than the thickness T. The feedback element 200 can have thickness dimension T of approximately 0.002 of a wavelength at an operating frequency of the antenna. One of ordinary skill in the art recognizes that other magnitudes of thickness T are not beyond the scope of the invention.

Next, in step 915, the feedback system 201 can be positioned adjacent to the crossed dipole pair dual polarized antenna 115. In this step, the spacing from the antenna 115 by a certain magnitude and the angular orientation of the feedback system 201 can be determined. For angular orientation, the first geometrical line 204C defined by the length dimension of the feedback element 200 can be positioned at an angle relative to each second and third geometrical lines 204A, 204B defined by the length dimensions of the crossed dipole pair antenna 115. Specifically, the first geometrical line 204C can be positioned at an angle of approximately forty-five degrees relative to the second and third geometrical lines 204B, 204C while the first geometrical line 204C crosses the center 208 of the crossed dipole pair antenna 115.

For spacing, the feedback element 200 can be positioned relative to a plane defined by the second and third geometrical lines 204A, 204B (of FIG. 2) of the crossed dipole pair dual polarized antenna 115. The spacing between a substantially linear portion of the feedback element 200 and the geometric plane defined by the second and third geometrical lines 204A, 204B can be approximately 0.007 of a wavelength at an operating frequency of the crossed dipole pair, dual polarized antenna. In other words, the feedback element 200 is positioned by a fastening mechanism 402 so that it can "float" above the crossed dipole pair dual polarized antenna 115 at a distance of approximately 0.007 of a wavelength at an operating frequency of the crossed dipole pair, dual polarized antenna 115. One of ordinary skill in the art recognizes that other magnitudes of the spacing between the feedback element 200 and the antenna 115 are not beyond the scope of the invention.

Next in step 920, the feedback system 201 is fastened to the crossed dipole dual polarized antenna 115 using one or more of the fastening mechanisms 402 described above in connection with FIG. 4. In step 925, RF signals are supplied to the crossed dipole pair dual polarized antenna 115 by either feed lines in a transmitting mode of operation or excitation of the crossed dipoles from received RF signals. Next, in step 930, the feedback system 201 is excited with RF signals produced by the crossed dipoles of the antenna 115. This excitation of the feedback system 201 can be from RF signals originating from or received by the crossed dipole pair dual polarized antenna 115.

In step 935, the feedback system 201 generates one or more feedback signals. In step 940, the one or more feedback signals are electromagnetically coupled to at least one dipole of the crossed dipole pair dual polarized antenna 115. In step 945, the feedback signals cancel leakage signals present at one or more ports of the crossed dipole pair dual polarized antenna 115. The process then ends.

While the invention has been described in its exemplary forms, it should be understood that the present disclosure has been made only by way of example and that numerous changes in the details of construction and the combination and arrangement of parts may be resorted to without departing from the spirit and scope of the invention. Accordingly, the scope of the present invention is defined by the appended claims rather than the foregoing description.

What is claimed is:

1. An antenna system comprising:

a crossed dipole pair dual polarized antenna, the crossed dipole pair dual polarized antenna comprising a first dipole and a second dipole that intersect along a longitudinal axis of the crossed dipole pair dual polarized antenna; and a feedback element electromagnetically coupled to the crossed dipole pair dual polarized antenna for generating a feedback signal that is received by at least one of the dipoles;

the feedback element comprising at least one conductive planar strip;

the feedback element intersecting the longitudinal axis and being spaced apart from the intersection of the crossed first and second dipoles;

the feedback element generating the feedback signal in response to receiving electromagnetic signals transmitted by at least one of the dipoles, the feedback signal operative to cancel leakage signals and thereby increase an isolation characteristic of the antenna system.

2. The antenna system of claim 1, further comprising:

a fastening mechanism;

the fastening mechanism fastening the feedback element directly to the crossed dipole pair dual polarized antenna.

3. The antenna system of claim 2, wherein the fastening mechanism spaces the feedback element apart from the intersection of the crossed first and second dipoles at a distance of approximately 0.007 of a wavelength at an operating frequency of the antenna.

4. The antenna system of claim 2, wherein the fastening mechanism comprises at least two tabs.

5. The antenna system of claim 4, wherein the fastening mechanism further comprises an epoxy.

6. The antenna system of claim 2, wherein the fastening mechanism consists of an adhesive.

7. The antenna system of claim 6, wherein the adhesive comprises an epoxy.

8. The antenna system of claim 1, wherein a length of the conductive planar strip is between approximately one-eighth (⅛) and approximately one-half (½) of a wavelength at an operating frequency of the antenna.

9. The antenna system of claim 1, wherein a width of the conductive planar strip is approximately fourteen thousandths (0.014) of a wavelength at an operating frequency of the antenna.

10. The antenna system of claim 1, wherein a thickness of the conductive planar strip is approximately two thousandths (0.002) of a wavelength at an operating frequency of the antenna.

11. The antenna system of claim 1, wherein the conductive planar strip comprises a "C" shape.

12. The antenna system of claim 11, wherein the "C" shape is oriented such that a concave side of the "C" shape faces the crossed dipole pair dual polarized antenna.

13. The antenna system of claim 1, wherein the feedback element is oriented at an angle of approximately forty-five degrees relative to each dipole of the crossed dipole pair dual polarized antenna.

14. The antenna system of claim 1, a width of the conductive planar strip being between approximately 0.002 and approximately 0.02 of a wavelength at an operating frequency of the antenna;

a thickness of the conductive planar strip being between approximately 0.001 and approximately 0.01 of a wavelength at an operating frequency of the antenna;

a spacing of the feedback element from the intersection of the crossed first and second dipoles being between approximately 0.001 and approximately 0.15 of a wavelength at an operating frequency of the antenna.

15. A method for increasing an isolation characteristic of an antenna system, comprising:

providing a crossed dipole pair dual polarized antenna, the crossed dipole pair dual polarized antenna comprising a first dipole and a second dipole that intersect along a longitudinal axis of the crossed dipole pair dual polarized antenna;

providing a feedback element comprising at least one conductive planar strip with a predetermined length;

positioning the feedback element to intersect the longitudinal axis and to be spaced apart from the intersection of the crossed first and second dipoles, in a position in which the feedback element generates a feedback signal in response to electromagnetic signals supplied to the crossed dipole pair dual polarized antenna, the feedback signal being operative to cancel leakage signals and thereby increase an isolation characteristic of the antenna system.

16. The method of claim 15, further comprising:

fastening the feedback element to the crossed dipole pair dual polarized antenna with a combination of tabs and an adhesive.

17. The method of claim 15, further comprising:

fastening the feedback element to the crossed dipole pair dual polarized antenna with an adhesive.

18. The method of claim 15, further comprising:

fastening the feedback element to the crossed dipole pair dual polarized antenna with tabs extending from the at least one conductive planar strip.

19. The method of claim 15, wherein the step of providing a feedback element further comprises sizing the predetermined length to be between approximately one-eighth (⅛) and approximately one-half (½) of a wavelength at an operating frequency of the antenna.

20. The method of claim 15, wherein the positioning step further comprises spacing the feedback element apart from the intersection of the crossed first and second dipoles at a distance of approximately 0.007 of a wavelength at an operating frequency of the antenna.

* * * * *